US011078644B2

(12) United States Patent
Cantu et al.

(10) Patent No.: US 11,078,644 B2
(45) Date of Patent: Aug. 3, 2021

(54) HYBRID LOAD BUCKET ASSEMBLY

(71) Applicant: Deere & Company, Moline, IL (US)

(72) Inventors: Jorge Luis Cantu, Monterrey (MX); Sanjeev M. Hallale, Pune (IN); Satyam Sahay, Pune (IN); Mohamad S. El-Zein, Bettendorf, IA (US); Hema V. Guthy, Moline, IL (US); Vikas Shinde, Pune (IN); Hector Portillo, Monterrey (MX); Israel Priego, Augusta, GA (US); Daniel Chapa, Monterrey (MX)

(73) Assignee: DEERE & COMPANY, Moline, IL (US)

( * ) Notice: Subject to any disclaimer, the term of this patent is extended or adjusted under 35 U.S.C. 154(b) by 521 days.

(21) Appl. No.: 15/950,756

(22) Filed: Apr. 11, 2018

(65) Prior Publication Data

US 2019/0316318 A1 Oct. 17, 2019

(51) Int. Cl.

| | |
|---|---|
| ***E02F 3/40*** | (2006.01) |
| ***E02F 3/34*** | (2006.01) |
| ***E02F 3/36*** | (2006.01) |
| *E02F 3/76* | (2006.01) |

(52) U.S. Cl.

CPC ..... *E02F 3/401* (2013.01); *E02F 3/3417* (2013.01); *E02F 3/3686* (2013.01); *E02F 3/7609* (2013.01)

(58) Field of Classification Search

CPC . E02F 3/40; E02F 3/401; E02F 3/3417; E02F 3/3686; E02F 3/7609

See application file for complete search history.

(56) References Cited

U.S. PATENT DOCUMENTS 2,185,176 A * 1/1940 Bager ..... E02F 3/40 37/444
3,947,982 A * 4/1976 Mantovani ..... E02F 9/2816 37/450
3,984,929 A * 10/1976 Meyer ..... E02F 9/2816 37/449

(Continued)

FOREIGN PATENT DOCUMENTS

| | | |
|---|---|---|
| DE | 8804501 U1 | 8/1988 |
| EP | 0435796 A1 | 7/1991 |
| WO | 2015196251 A1 | 12/2015 |

OTHER PUBLICATIONS

Construction Equipment Guide, Composite Cutting Edge From Nye Designed for Excavator, Loader Buckets, ConstructionEquipmentGuide.com,National Edition, Dec. 16, 2009.

(Continued)

*Primary Examiner* — Jamie L McGowan
(74) *Attorney, Agent, or Firm* — Tucker Ellis LLP; Michael G. Craig; Heather M. Barnes

(57) ABSTRACT

A hybrid bucket assembly for a work vehicle having movable loader arms includes a reinforcing structure having a first edge plate, a second edge plate and at least two support members extending from the first edge plate. The reinforcing structure is for coupling the bucket assembly to the movable loader arms. The bucket assembly includes a double-wall bucket defining a volume for carrying material. The bucket is coupled to the at least two support members of the reinforcing structure, and the bucket has a leading edge coupled between the first edge plate and the second edge plate.

19 Claims, 19 Drawing Sheets

(56) References Cited

U.S. PATENT DOCUMENTS 4,043,060 A * 8/1977 Stepe ..... E02F 9/2841 37/446
4,052,803 A * 10/1977 Lanz ..... E02F 9/2816 37/449
4,086,712 A * 5/1978 McReynolds ..... E02F 3/401 37/444
4,729,180 A * 3/1988 Hendricks ..... E02F 9/2808 37/450
5,012,599 A * 5/1991 DeClair ..... E02F 3/401 37/444
5,063,694 A * 11/1991 McCreary, Jr. ..... E02F 3/40 37/444
5,267,402 A * 12/1993 Russell ..... E02F 3/40 37/379
6,186,735 B1 * 2/2001 Deyo ..... E02F 3/40 29/466
6,408,551 B1 * 6/2002 Pettersson ..... B07B 1/12 37/409
6,457,268 B1 * 10/2002 Perry ..... E02F 3/8152 37/403
7,484,321 B1 * 2/2009 Stafne, Sr. ..... E02F 3/401 37/227
7,698,839 B1 4/2010 Phillips et al.
7,718,724 B2 5/2010 DeCristofaro et al.
8,827,627 B2 9/2014 Landry et al.
9,416,520 B2 * 8/2016 Sheehan ..... E02F 9/2883
9,732,496 B1 * 8/2017 Newman ..... E02F 3/40
9,963,857 B2 * 5/2018 Ruvang ..... E02F 9/2825
10,024,027 B2 * 7/2018 Worth ..... E02F 3/40
10,662,610 B2 * 5/2020 Rupp ..... E02F 3/40
2001/0005950 A1 * 7/2001 Renski ..... E02F 3/8152 37/444
2003/0066215 A1 * 4/2003 Grant ..... E02F 3/40 37/446
2004/0098886 A1 * 5/2004 Hohmann ..... E02F 9/2833 37/451
2005/0254935 A1 11/2005 Downing
2006/0182590 A1 * 8/2006 McFarland ..... E02F 3/40 414/685
2014/0173947 A1 * 6/2014 Stewart ..... E02F 3/402 37/444
2017/0349109 A1 * 12/2017 McLoughlin ..... E02F 3/34
2017/0350091 A1 * 12/2017 Worth ..... E02F 3/3405

OTHER PUBLICATIONS

VABO Composites: Consortium Wins Prestigious Innovation Award, 2017.
VABO Composites: Dutch Innovator Excels in Diverse Applications: CompositesWorld, May 24, 2016.
NLR Netherlands Aerospace Center news article: Lightweight Bucket for Heavy Construction Work, nlr.org/news, Mar. 2015.
NLR Netherlands Aerospace Center news article: Fokker and NLR Open High-Tech Pilot Plant for Composite Components, nlr.org/news, Mar. 2015.
Delta HL, Light Material Loader Buckets, Delta HL, spol. s.r.o. 2016.
Delta HL, Other Loader Buckets, Delta HL, spol. s.r.o. 2016.
European Search Report issued in counterpart application No. 19160817.3, dated Jul. 22, 2019, 11 pages.

* cited by examiner

HYBRID LOAD BUCKET ASSEMBLY

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles and load buckets in which the work vehicles carry material.

BACKGROUND OF THE DISCLOSURE

In the agriculture, construction and forestry industries, various work machines, such as loaders, may be utilized in lifting and moving various materials. In certain examples, a loader may include a bucket pivotally coupled by a boom or loader arms to the vehicle chassis. One or more hydraulic cylinders move the boom or loader arms and/or the bucket to move the bucket between positions relative to the chassis to lift and move materials.

Various factors are considered when designing or selecting the loader and bucket arrangement used, for example, the durability and wear resistance of the bucket, especially at the bottom leading edge, and the volume of material the bucket can carry. These factors typical indicate that the loader arms and bucket be made of heavy steel plate construction to handle large volumes of material and the corresponding weight and other forces associated with loading and carrying the heavy material. This also requires a robust hydraulic system with correspondingly large-capacity pumps, accumulators, valves and cylinders. Further, wear or damage to the bucket may also require replacement or vehicle downtime to repair the heavy-duty components.

SUMMARY OF THE DISCLOSURE

The disclosure provides a hybrid load bucket assembly in which a reinforcing structure that mounts to a loader arm carrier supports a bucket. In some cases, the bucket may be of lightweight construction and removably attached to the reinforcing structure.

In one aspect, a hybrid bucket assembly for a work vehicle having movable loader arms is provided. The bucket assembly includes a reinforcing structure having a first edge plate, a second edge plate and at least two support members extending from the first edge plate. The reinforcing structure is for coupling the bucket assembly to the movable loader arms. The bucket assembly includes a double-wall bucket defining a volume for carrying material. The bucket is coupled to the at least two support members of the reinforcing structure, and the bucket has a leading edge coupled between the first edge plate and the second edge plate.

In another aspect, the disclosure provides a hybrid bucket assembly for a work vehicle having movable loader arms and an operator cab. The bucket assembly includes a top side, a bottom side, lateral sides formed integrally with or coupled to opposite lateral surfaces of the bottom side and the top side, and a rear side formed integrally with or coupled to the top side, the bottom side and the lateral sides. The top side, the bottom side, the rear side and the lateral sides form a bucket having a volume for carrying material. The rear side includes a translucent region that is configured to transmit light from the volume to the operator cab and to retain material within the volume.

In yet another aspect, the disclosure provides a hybrid bucket assembly for a work vehicle having movable loader arms. The bucket assembly includes a reinforcing structure having a first edge plate, a second edge plate, a wear plate and at least two support members extending from the first edge plate. The wear plate is coupled between the first edge plate and the second edge plate. The reinforcing structure is for coupling the bucket assembly to the movable loader arms. The bucket assembly includes a double-wall bucket formed from a polymer-based material defining a volume for carrying material. The bucket is coupled to the at least two support members of the reinforcing structure, and the bucket has a leading edge coupled between the first edge plate and the second edge plate so as to be proximate the wear plate.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
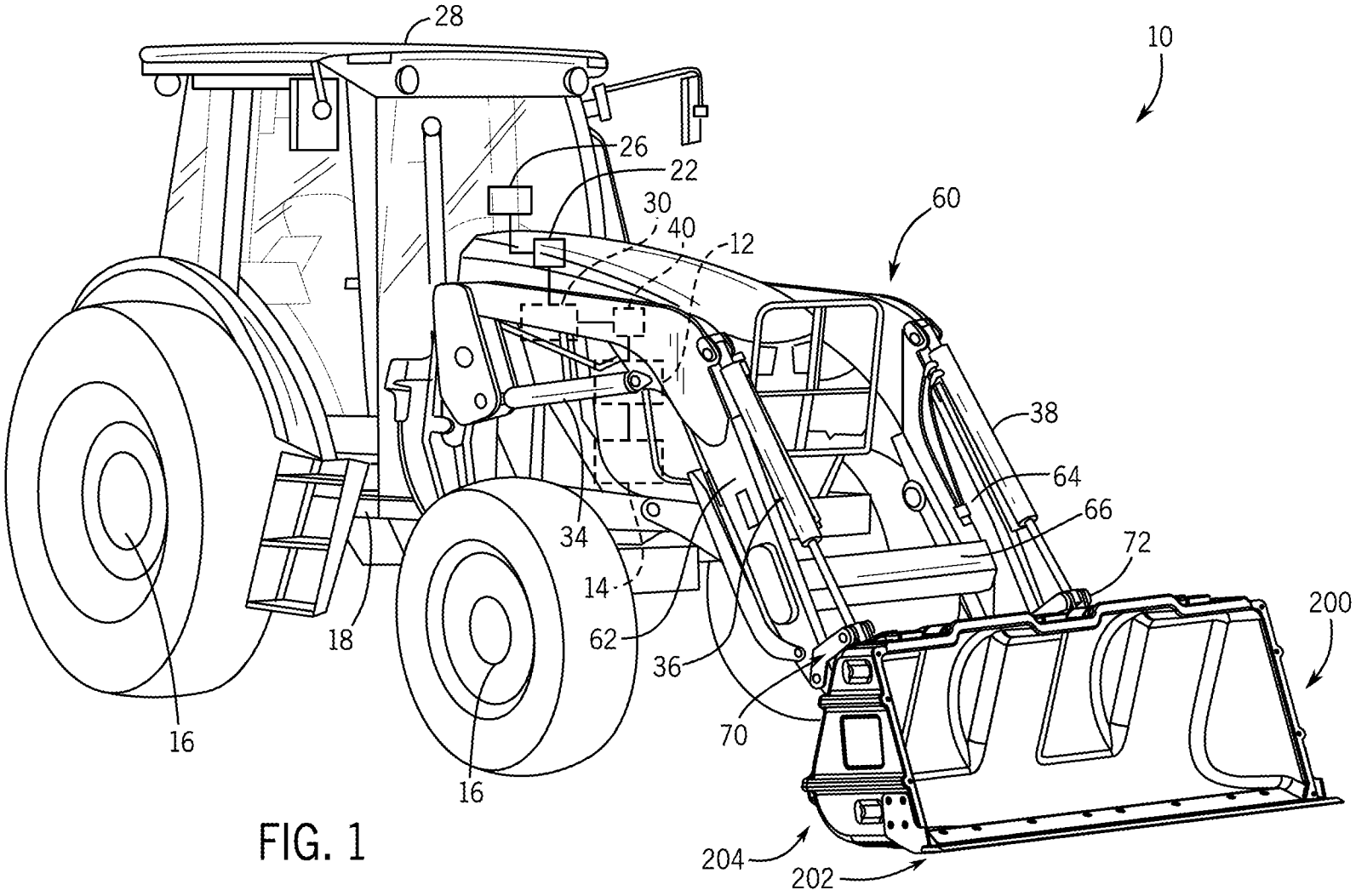
FIG. 1 is a perspective view of an example work vehicle in the form of an agricultural loader in which the disclosed hybrid load bucket assembly may be used.

The following describes one or more example embodiments of the disclosed hybrid load bucket assembly, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Conventional load buckets for use in various construction and agricultural applications to haul materials (e.g., dirt, sand, aggregate and so on) are typically cast or fabricated of heavy-duty construction using high-strength materials (e.g., steel). The heavy-duty construction affords conventional load buckets the ability to undergo extreme loading and treatment during use as well as provide for high load volumes (e.g., 1, 2 or more cubic yards). In addition to the material itself, the weight of the heavy-duty bucket most be accommodated by the host machine, and specifically by its hydraulic system, to ensure that the machine performs as expected, that is will raise and lower the load bucket at the rate and range of motion desired. Further, as heavy and rugged as they are, encountering sufficient loading, abrasion or other forces can cause damage to conventional load buckets. The load buckets may yield (i.e., crack) due to impact or stress concentrations, or they may experience wear (e.g., at the lower leading or "cutting" edge of the bucket) that may impact the performance of the machine. Damage or worn load buckets may need to be replaced or repaired at significant expense or operational downtime of the machine.

This disclosure provides an alternative to the conventional load bucket through the use of a hybrid assembly of a reinforcing structure that supports a double-wall bucket, which defines the load volume for containing the material. In certain embodiments, this permits the bucket to be a light-duty construction, such as made with any suitable thin-walled or lightweight materials. For example, the disclosed hybrid load bucket assembly ("HLBA") may have a bucket formed of a polymer-based material, including, but not limited to, polyethylene, nylon and polyamide. The bucket may be formed using any suitable molding technique (e.g., rotational molding). In this way, the disclosed HLBA may have both lightweight and low-cost attributes. It should be noted that the bucket may be formed with non-resin materials, such as various metals, in which case the bucket shell may also have a thin-walled, lightweight construction. Various advanced, technical materials (e.g., magnesium alloys, carbon fiber, Kevlar® and the like) may also be used.

The bucket is supported and coupled to the machine by the reinforcing structure. In the case of light-duty constructions the bucket may be primarily supported and reinforced by the reinforcing structure so that the loading realized by the bucket during use is carried by the reinforcing structure to the machine. Further, the reinforcing structure may also provide for support around the periphery of the bucket as well as at the leading (or cutting) edge of the bucket, which tends to maintain the shape of the bucket (and thereby the load volume) as well as provide a leading edge that is more resistant to wear. The HLBA may also be configured so that the bucket is recessed within the reinforcing structure to further reduce leading edge wear on the bucket shell.

In various embodiments, the HLBA may be configured so that the bucket is removably mounted to the reinforcing structure. For example, various mechanical fasteners and the like may be used to secure the bucket to the reinforcing structure. The bucket and/or the reinforcing structure may also be configured with features that aid in mounting and dismounting such a removable bucket. For example, the bucket may have integrally formed mounting features through which mechanical fasteners may extend when mounting to the reinforcing structure. These integrally formed mounting features enable the bucket to withstand the bolt torque applied when coupling the reinforcing structure to the bucket with mechanical fasteners. Irrespective of the configurational details, removably mounting the bucket allows for rapid (and as mentioned above, low-cost) replacement of the bucket, and thus repair of the HLBA. In certain examples, the reinforcing structure may be a snap-fit reinforcing structure, which may be snapped into engagement with a removable bucket.

In addition, in various embodiments, the bucket may include a gauge that enables an operator to view a quantity of material contained within a volume of the bucket without leaving an operator cab associated with the work vehicle. This improves a cycle time and operational efficiency of the work vehicle. In certain embodiments, a rear panel of the bucket may be translucent or transparent, to enable the operator to view a quantity of material within the volume of the bucket. In other embodiments, an entirety of the bucket may be translucent or transparent, such that the operator may view the quantity of material present within the volume of the bucket.

Figure 2:
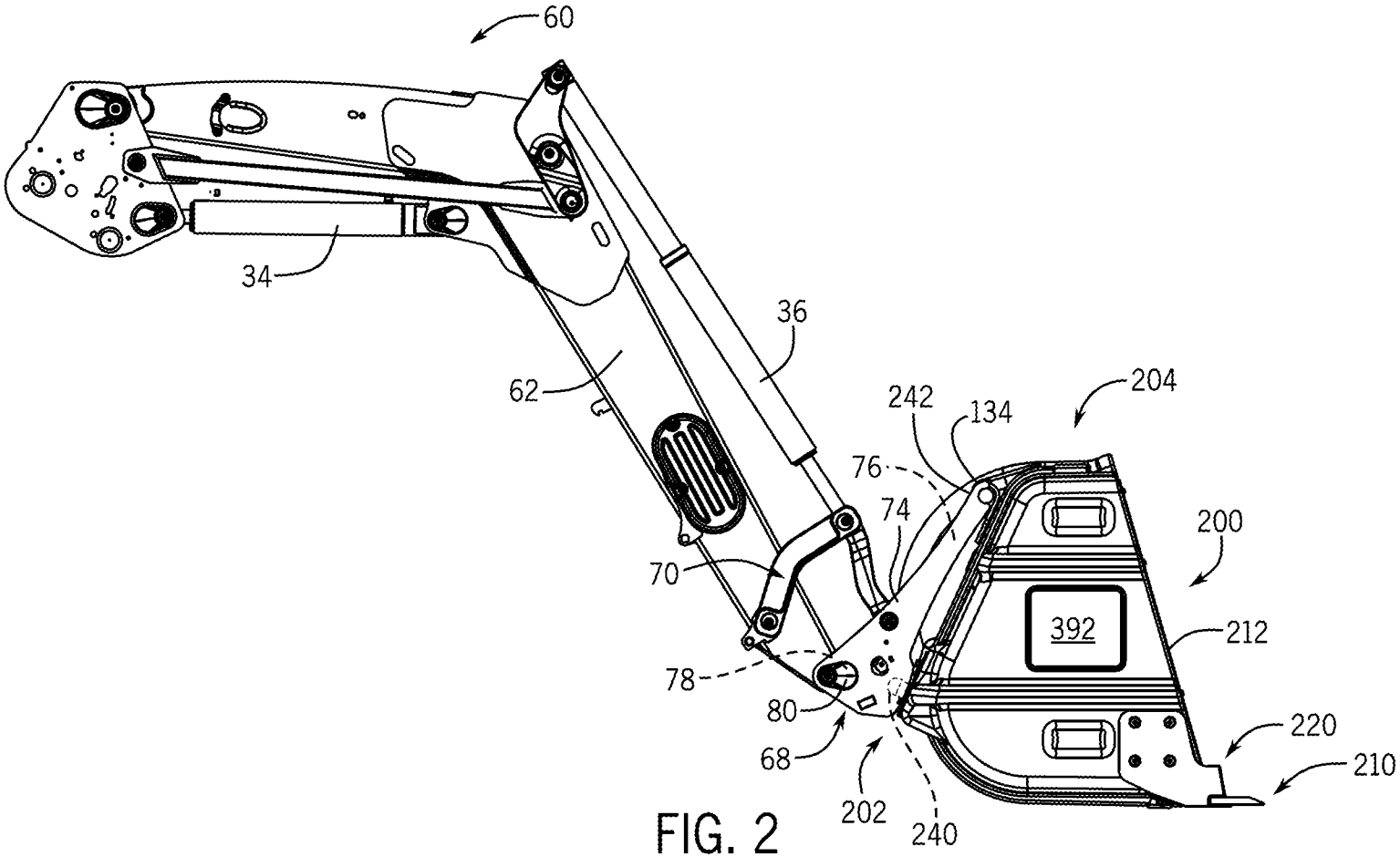
FIG. 2 is a side view of an example loader arm assembly with the hybrid load bucket assembly as shown in FIG. 1.

The following describes one or more example implementations of the disclosed HLBA. The HLBA may be utilized with various machines or work vehicles, including loaders and other machines for lifting and moving various materials in the agricultural and construction industries. Referring to FIGS. 1 and 2, in some embodiments, a HLBA 200 may be used with an agricultural loader 10. It will be understood that the configuration of the loader 10 is presented as an example only. In this regard, the disclosed HLBA may be implemented as a front loader removably coupled to a work vehicle, such as a tractor. Other work vehicles, such as dedicated wheel loaders used in the construction industry, may benefit from the disclosed HLBA as well, including, but not limited to, tracked loaders.

Generally, the loader 10 includes a source of propulsion, such as an engine 12 that supplies power to a transmission 14. In one example, the engine 12 is an internal combustion engine, such as a diesel engine, that is controlled by an engine control module. The transmission 14 transfers power from the engine 12 to a suitable driveline coupled to one or more driven wheels 16 of the loader 10 to enable the loader 10 to move. The engine 12, the transmission 14 and the rest of the driveline are supported by a vehicle chassis 18, which is supported off the ground by the wheels 16. As is known to one skilled in the art, the transmission 14 can include a suitable gear transmission, which can be operated in a variety of ranges containing one or more gears, including, but not limited to a park range, a neutral range, a reverse range, a drive range, a low range, a high range, etc. The transmission 14 may be controlled by a transmission control module, which is, along with the engine control module, in communication with a master controller 22 (or group of controllers).

The controller 22 may control various aspects of the operation of the loader 10 and may be configured as a computing device with associated processor devices and memory architectures, as a hard-wired computing circuit (or circuits), as a programmable circuit, as a hydraulic, electrical or electro-hydraulic controller, or otherwise. As such, the controller 22 may be configured to execute various computational and control functionality with respect to the loader 10 (or other machinery). In some embodiments, the controller 22 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 22 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 22 may be in electronic, hydraulic, mechanical, or other communication with various other systems or devices of the loader 10 (or other machinery). For example, the controller 22 may be in electronic or hydraulic communication with various actuators, sensors, and other devices within (or outside of) the loader 10, including various devices associated with a hydraulic system. The controller 22 may communicate with other systems or devices (including other controllers) in various known ways, including via a CAN bus (not shown) of the loader 10, via wireless or hydraulic communication means, or otherwise. An example location for the controller 22 is depicted in FIG. 1. It will be understood, however, that other locations are possible including other locations on the loader 10, or various remote locations. In some embodiments, the controller 22 may be configured to receive input commands and to interface with an operator via a human-machine interface 26, which may be disposed inside a cab 28 of the loader 10 for easy access by the operator. The human-machine interface 26 may be configured in a variety of ways and may include one or more joysticks, various switches or levers, one or more buttons, a touchscreen interface that may be overlaid on a display, a keyboard, a speaker, a microphone associated with a speech recognition system, or various other human-machine interface devices.

The loader 10 also has a hydraulic system that includes one or more pumps and accumulators (designated generally by reference number 30), which may be driven by the engine 12 of the loader 10. Flow from the pumps 30 may be routed through various control valves and various conduits (e.g., flexible hoses) to drive various hydraulic cylinders, such as hydraulic cylinders 34, 36, 38, shown in FIG. 1. Flow from the pumps (and accumulators) 30 may also power various other components of the loader 10. The flow from the pumps 30 may be controlled in various ways (e.g., through control of various electro-hydraulic control valves 40) to cause movement of the hydraulic cylinders 34, 36, 38, and thus, the HLBA 200 relative to the loader 10. In this way, for example, movement of the HLBA 200 between various positions relative to the chassis 18 of the loader 10 may be implemented by various control signals to the pumps 30, control valves 40, and so on.

In the embodiment depicted, the HLBA 200 is pivotally mounted to a boom assembly 60, which in this example, includes a first loader arm 62 and a second loader arm 64, which are interconnected via a cross-beam 66 to operate in parallel. The loader arms 62, 64 are each coupled to the chassis 18, directly or via another frame portion of the loader 10, at one end, and are coupled at an opposite end to the HLBA 200 via a carrier 68, which is pivoted via first and second (left and right) pivot linkages 70, 72. In the illustrated example, the carrier 68 comprises first and second (left and right) couplers 74, 76, connected by a cross-rod 78, that mount to the distal ends of the respective loader arms 62, 64 via coupling pins 80. Additional pins pivotally couple the pivot linkages 70, 72 between the loader arms 62, 64 and the respective first and second couplers 74, 76. The pivot linkages 70, 72 enable pivotal movement of the HLBA 200 upon actuation of the hydraulic cylinders 36, 38.

The hydraulic cylinders 34 may be actuated to raise and lower the boom assembly 60 relative to the loader 10. In the illustrated example, the boom assembly 60 includes two hydraulic cylinders, namely the hydraulic cylinder 34 coupled between the chassis 18 and the first loader arm 62 and a corresponding cylinder on the opposite side of the loader (not shown) coupled between the chassis 18 and the second loader arm 64. It should be noted that the loader 10 may have any number of hydraulic cylinders, such as one, three, etc. Each of the hydraulic cylinders 34 includes an end coupled to the chassis 18 (e.g., via a coupling pin) and an end mounted to the respective one of the first loader arm 62 and the second loader arm 64 (e.g., via another pin). Upon activation of the hydraulic cylinders 34, the boom assembly 60 may be moved between various positions to elevate the boom assembly 60, and thus the HLBA 200, relative to the chassis 18 of the loader 10.

One or more hydraulic cylinders 36 are mounted to the first loader arm 62 and the first pivot linkage 70, and one or more hydraulic cylinders 38 are mounted to the second loader arm 64 and the second pivot linkage 72. In the illustrated example, the loader 10 includes a single hydraulic cylinder 36, 38 associated with a respective one of the first loader arm 62 and the second loader arm 64, respectively. Each of the hydraulic cylinders 36, 38 includes an end mounted to the respective one of the first loader arm 62 and the second loader arm 64 (via another pin) and an end mounted to the respective one of the first pivot linkage 70 and the second pivot linkage 72 (via another pin). Upon activation of the hydraulic cylinders 36, 38, the HLBA 200 may be moved between various positions, namely to pivot the carrier 68, and thereby the HLBA 200, relative to the boom assembly 60.

Thus, in the embodiment depicted, the HLBA 200 is pivotable about the carrier 68 of the boom assembly 60 by the hydraulic cylinders 36, 38. As noted, in some embodiments, a different number or configuration of hydraulic cylinders or other actuators may be used. Accordingly, it will be understood that the configuration of the hydraulic system and the boom assembly 60 is presented as an example only. In this regard, in other contexts, a hoist boom (e.g. the boom assembly 60) may be generally viewed as a boom that is pivotally attached to a vehicle frame, and that is also pivotally attached to an end effector (e.g., the HLBA 200). Similarly, the carrier 68 (e.g., the couplers 74, 76) may be generally viewed as a component effecting pivotal attachment of a bucket (e.g. the HLBA 200) to a vehicle frame. In this light, a tilt actuator (e.g., the hydraulic cylinders 36, 38) may be generally viewed as an actuator for pivoting a receptacle with respect to a hoist boom, and the hoist actuator (e.g. the hydraulic cylinders 34) may be generally viewed as an actuator for pivoting a hoist boom with respect to a vehicle frame.

In certain applications, sensors (e.g., pressure, flow or other sensors) may be provided to observe various conditions associated with the loader 10. For example, the sensors may include one or more pressure sensors that observe a pressure within the hydraulic circuit, such as a pressure associated with at least one of the pumps 30, the control valves 40 and/or one or more hydraulic cylinders 34, 36, 38 to observe a pressure within the hydraulic cylinders and generate sensor signals based thereon. In some cases, various sensors may be disposed on or near the carrier 68 and/or the HLBA 200. For example, sensors (e.g. inertial measurement sensors) may be coupled on or near the HLBA 200 to observe or measure parameters including the acceleration of the boom assembly 60 and/or the HLBA 200 and generate sensor signals, which may indicate if the boom assembly 60 and/or the HLBA 200 is accelerating or decelerating. In some embodiments, various sensors (e.g., angular position sensors) may be configured to detect the angular orientation of the HLBA 200 relative to the boom assembly 60, or to detect the angular orientation of the boom assembly relative to the chassis 18, and various other indicators of the current orientation or position of the HLBA 200. For example, rotary angular positon sensors may be used or linear position or displacement sensors may be used to determine the length of the hydraulic cylinders 34, 36, 38 relative to the boom assembly 60.

Figure 1A:
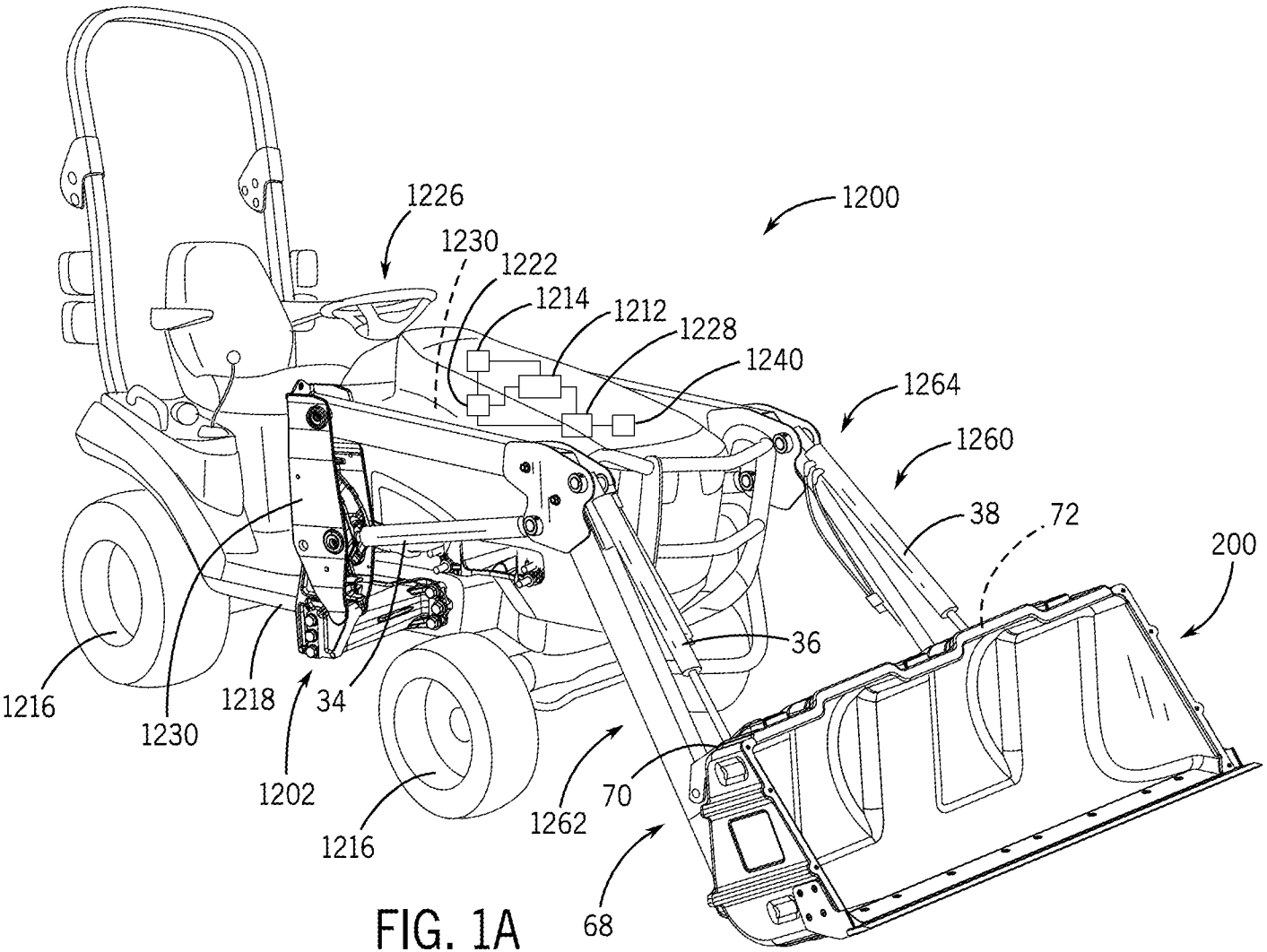
FIG. 1A is a perspective view of an example work vehicle in the form of a compact utility tractor in which the disclosed hybrid load bucket assembly may be used.

Referring to FIG. 1A, in some embodiments, the HLBA 200 may be used with a compact utility tractor 1200 having a front loader 1202 removably coupled to the compact utility tractor 1200. It will be understood that the implementation of the HLBA 200 with the compact utility tractor 1200 is presented as an example only. Generally, the compact utility tractor 1200 includes a source of propulsion, such as an engine 1212 that supplies power to a transmission 1214. In one example, the engine 1212 is an internal combustion engine, such as a diesel engine, that is controlled by an engine control module. The transmission 1214 transfers power from the engine 1212 to a suitable driveline coupled to one or more driven wheels 1216 of the compact utility tractor 1200 to enable the compact utility tractor 1200 to move. The engine 1212, the transmission 1214 and the rest of the driveline are supported by a vehicle chassis 1218, which is supported off the ground by the wheels 1216. As is known to one skilled in the art, the transmission 1214 can include a suitable gear transmission, which can be operated in a variety of ranges. The transmission 1214 may be controlled by a transmission control module, which is, along with the engine control module, in communication with a master controller 1222 (or group of controllers).

The controller 1222 may control various aspects of the operation of the compact utility tractor 1200 and may be configured as a computing device with associated processor devices and memory architectures, as a hard-wired computing circuit (or circuits), as a programmable circuit, as a hydraulic, electrical or electro-hydraulic controller, or otherwise. As such, the controller 1222 may be configured to execute various computational and control functionality with respect to the compact utility tractor 1200 (or other machinery). In some embodiments, the controller 1222 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 1222 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 1222 may be in electronic, hydraulic, mechanical, or other communication with various other systems or devices of the compact utility tractor 1200 (or other machinery), including the front loader 1202. For example, the controller 1222 may be in electronic or hydraulic communication with various actuators, sensors, and other devices within (or outside of) the compact utility tractor 1200, including various devices associated with a hydraulic system of the front loader 1202. The controller 1222 may communicate with other systems or devices (including other controllers) in various known ways, including via a CAN bus (not shown) of the compact utility tractor 1200, via wireless or hydraulic communication means, or otherwise. An example location for the controller 1222 is depicted in FIG. 1A. It will be understood, however, that other locations are possible including other locations on the compact utility tractor 1200, or various remote locations. In some embodiments, the controller 1222 may be configured to receive input commands and to interface with an operator via a human-machine interface 1226, which may be disposed for easy access by the operator. The human-machine interface 1226 is in communication with the controller 1222 over a suitable communication architecture, such as a CAN bus. The human-machine interface 1226 may be configured in a variety of ways and may include one or more joysticks, various switches or levers, a steering wheel, one or more buttons, a touchscreen interface that may be overlaid on a display, a keyboard, a speaker, a microphone associated with a speech recognition system, or various other human-machine interface devices.

The compact utility tractor 1200 also has a hydraulic system that includes one or more pumps and accumulators (designated generally by reference number 1228), which may be driven by the engine 1212 of the compact utility tractor 1200. Flow from the pumps 1228 may be routed through various control valves and various conduits (e.g., flexible hoses) to drive various hydraulic cylinders, such as hydraulic cylinders 34, 36, 38 associated with the front loader 1202, shown in FIG. 1A. Flow from the pumps (and accumulators) 1228 may also power various other components of the compact utility tractor 1200. The flow from the pumps 1228 may be controlled in various ways (e.g., through control of various electro-hydraulic control valves 1240) to cause movement of the hydraulic cylinders 34, 36, 38, and thus, the front loader 1202 relative to the compact utility tractor 1200 when the front loader 1202 is mounted on the compact utility tractor 1200 through a suitable mounting arrangement. In this way, for example, movement of the front loader 1202 between various positions relative to the chassis 1218 of the compact utility tractor 1200 may be implemented by various control signals to the pumps 1228, control valves 1240, and so on. The mounting arrangement may include a mast 1230 on each side of the front loader 1202 that cooperates with a mounting frame on each side of the compact utility tractor 1200 to removably couple the front loader 1202 to the compact utility tractor 1200.

In the embodiment depicted, the front loader 1202 includes the HLBA 200 is pivotally mounted to a boom assembly 1260, which in this example, includes a first loader arm 1262 and a second loader arm 1264, which are interconnected via a cross-beam 1266 to operate in parallel. The loader arms 1262, 1264 are each coupled to the chassis 1218, via a suitable mounting arrangement, at one end, and are coupled at an opposite end to the HLBA 200 via the carrier 68, which is pivoted via first and second (left and right) pivot linkages 70, 72. Pins pivotally couple the pivot linkages 70, 72 between the loader arms 1262, 1264 and the respective first and second couplers 74, 76. The pivot linkages 70, 72 enable pivotal movement of the HLBA 200 upon actuation of the hydraulic cylinders 36, 38.

The hydraulic cylinders 34 may be actuated to raise and lower the boom assembly 1260 relative to the compact utility tractor 1200. In the illustrated example, the boom assembly 1260 includes two hydraulic cylinders, namely the hydraulic cylinder 34 coupled between the mast 1230 of the front loader 1202 and the first loader arm 1262 and a corresponding cylinder on the opposite side of the loader (not shown) coupled between the mast 1230 and the second loader arm 1264. It should be noted that the compact utility tractor 1200 may have any number of hydraulic cylinders, such as one, three, etc. Each of the hydraulic cylinders 34 includes an end coupled to the mast 1230 (e.g., via a coupling pin) and an end mounted to the respective one of the loader arms 1262, 1264 (e.g., via another pin). Upon activation of the hydraulic cylinders 34, the boom assembly 1260 may be moved between various positions to elevate the boom assembly 1260, and thus the HLBA 200, relative to the compact utility tractor 1200.

One or more hydraulic cylinders 36 are mounted to the first loader arm 1262 and the first pivot linkage 70, and one or more hydraulic cylinders 38 are mounted to the second loader arm 1264 and the second pivot linkage 72. In the illustrated example, the front loader 1202 includes a single hydraulic cylinder 36, 38 associated with a respective one of the first loader arm 1262 and the second loader arm 1264, respectively. Each of the hydraulic cylinders 36, 38 includes an end mounted to the respective one of the first loader arm 1262 and the second loader arm 1264 (via another pin) and an end mounted to the respective one of the first pivot linkage 70 and the second pivot linkage 72 (via another pin). Upon activation of the hydraulic cylinders 36, 38, the HLBA 200 may be moved between various positions, namely to pivot the carrier 68, and thereby the HLBA 200, relative to the boom assembly 1260. Thus, in the embodiment depicted, the HLBA 200 is pivotable about the carrier 68 of the boom assembly 1260 by the hydraulic cylinders 36, 38. As noted, in some embodiments, a different number or configuration of hydraulic cylinders or other actuators may be used. Accordingly, it will be understood that the configuration of the hydraulic system and the boom assembly 1260 is presented as an example only.

The HLBA 200 generally defines a receptacle for carrying various materials, such as dirt, rocks, wet dirt, sand, hay, etc. In the example of FIG. 1, the HLBA 200 may receive about two cubic yards of material to over about five cubic yards of material. In the example of FIG. 1A, the HLBA 200 may receive about 300 Liters (10.6 cubic feet) of material. The HLBA 200 is movable upon actuation of the hydraulic cylinders 36, 38 between a level position, a roll-back position and a dump position, along with various positions in between. In the level position, the HLBA 200 can receive various materials. In the roll-back position, the HLBA 200 is pivoted upward relative to the earth's surface or ground by the actuation of the hydraulic cylinders 36, 38 such that the HLBA 200 may be loaded with and retain the various materials. In the dump position, the HLBA 200 is pivoted downward relative to the earth's surface or ground by the actuation of the hydraulic cylinders 36, 38 such that the various materials may fall from the HLBA 200 to substantially empty the HLBA 200.

Figure 3:
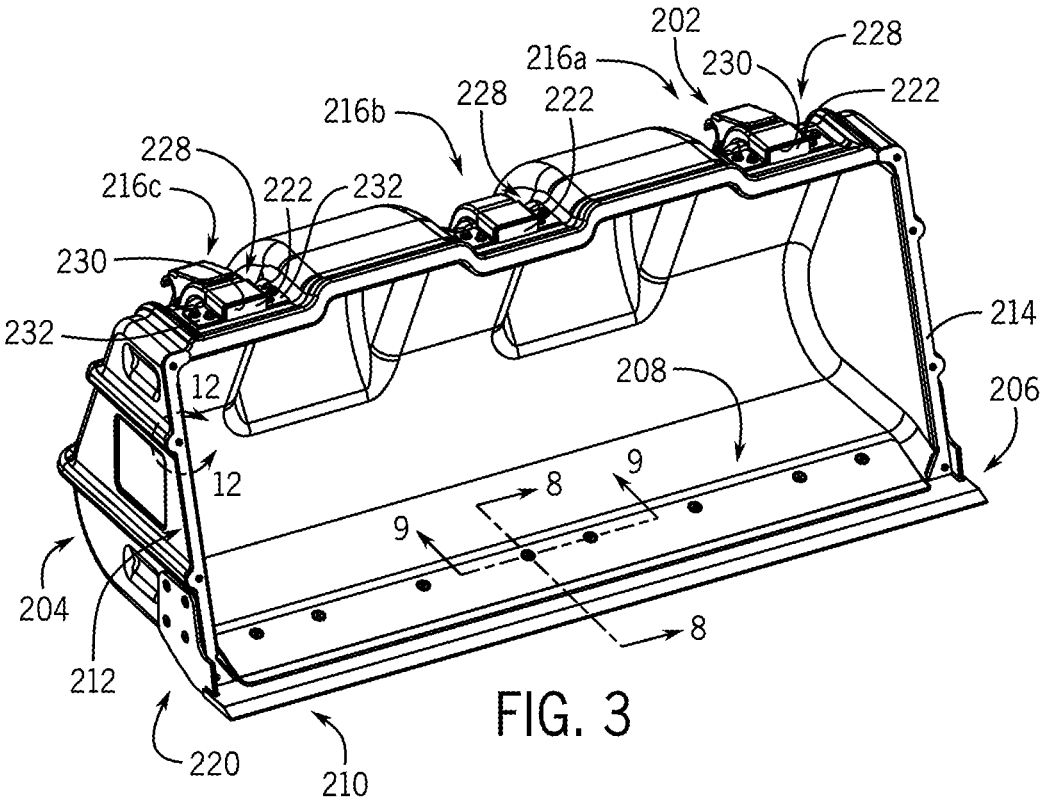
FIG. 3 is a perspective view of the hybrid load bucket assembly of FIG. 1 or FIG. 1A, which includes a reinforcing structure and a bucket in accordance with various embodiments.
Figure 4:
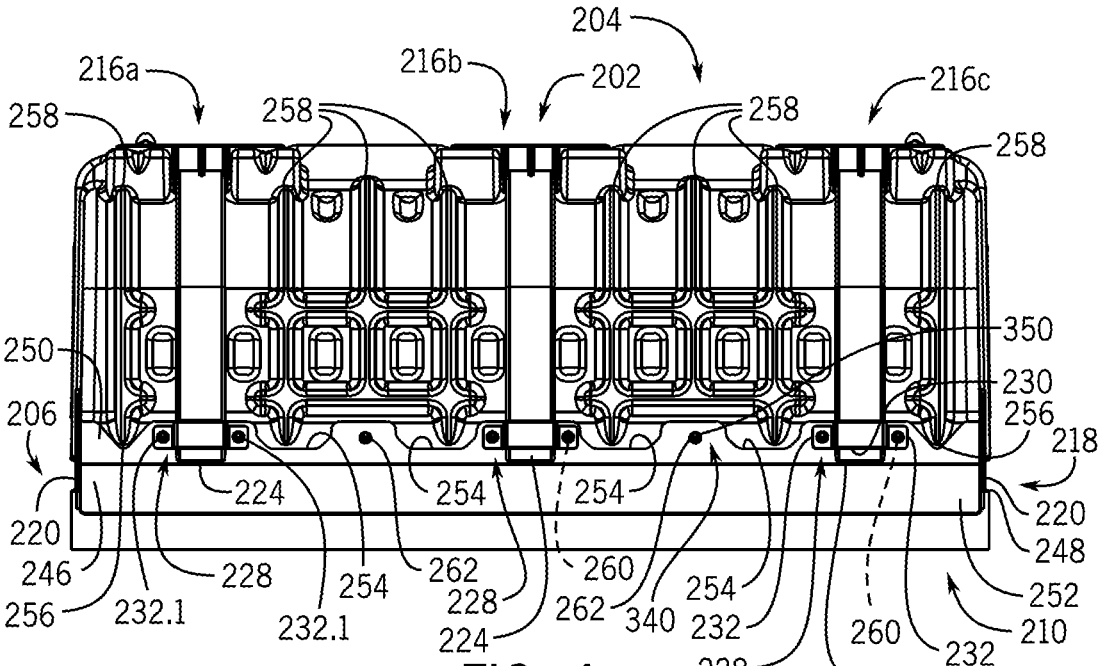
FIG. 4 is a top view of the hybrid load bucket assembly of FIG. 3.

Referring also to FIGS. 3 and 4, the exemplary HLBA 200 is shown. In this example, the HLBA 200 includes a reinforcing structure 202 and a bucket 204. In the illustrated example, the reinforcing structure 202 is external to the bucket 204. The reinforcing structure 202 facilitates removal and replacement of the bucket 204 should it be damaged. However, in other contexts, the reinforcing structure may be internal to the bucket, for example, with the bucket being constructed or formed (e.g., via an insert-molding operation) about the reinforcing structure in which molecular bonding or mechanical fasteners are used to connect, and transfer loads from, the bucket shell to the reinforcing structure 202. As noted above, the bucket 204 may be, and is in the illustrated example, of light-duty construction such that the reinforcing structure 202 supports the bucket 204 and provides the primary load-handling component of the HLBA 200.

Figure 5:
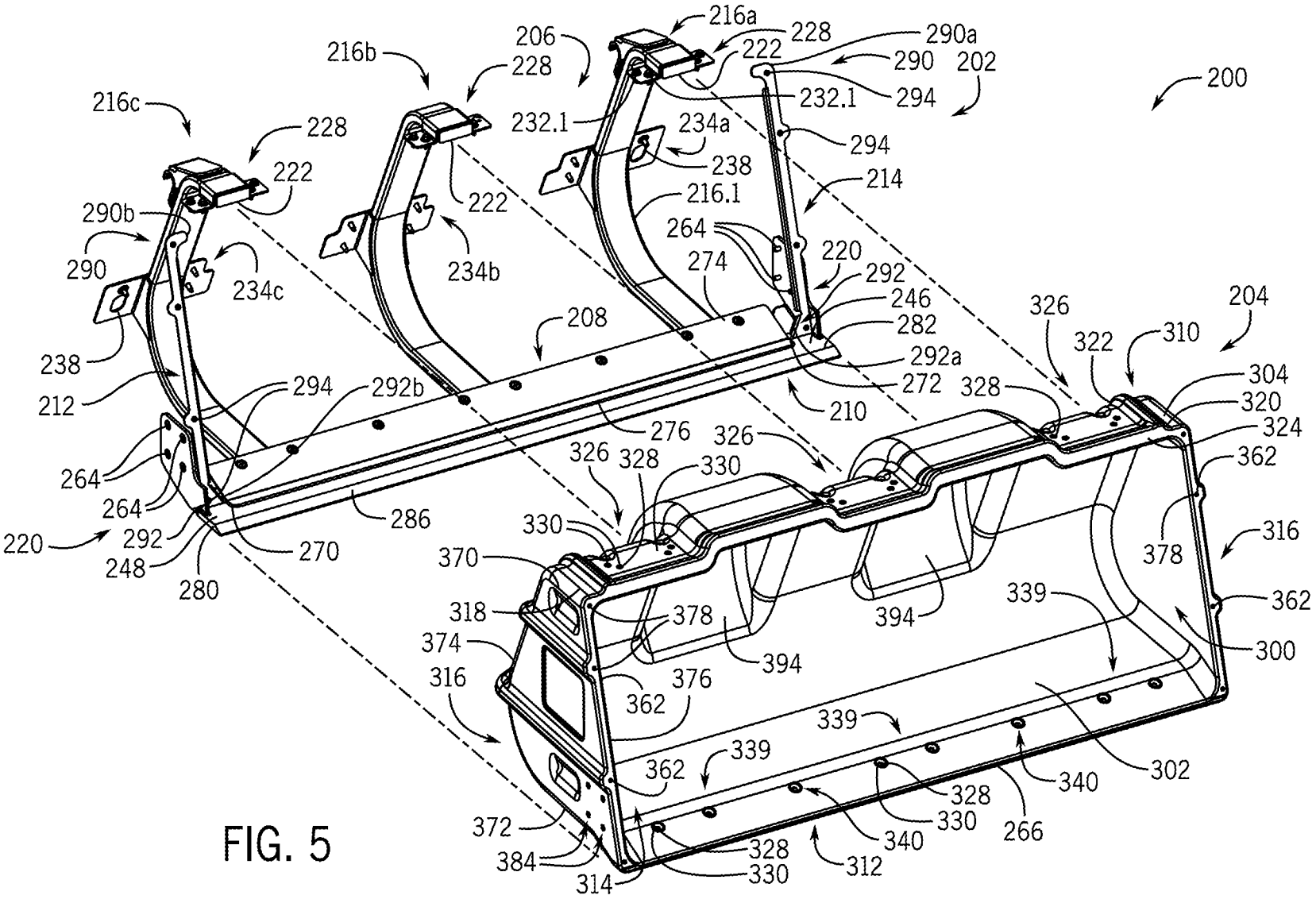
FIG. 5 is a partial exploded front perspective view of the hybrid load bucket assembly of FIG. 3.
Figure 8:
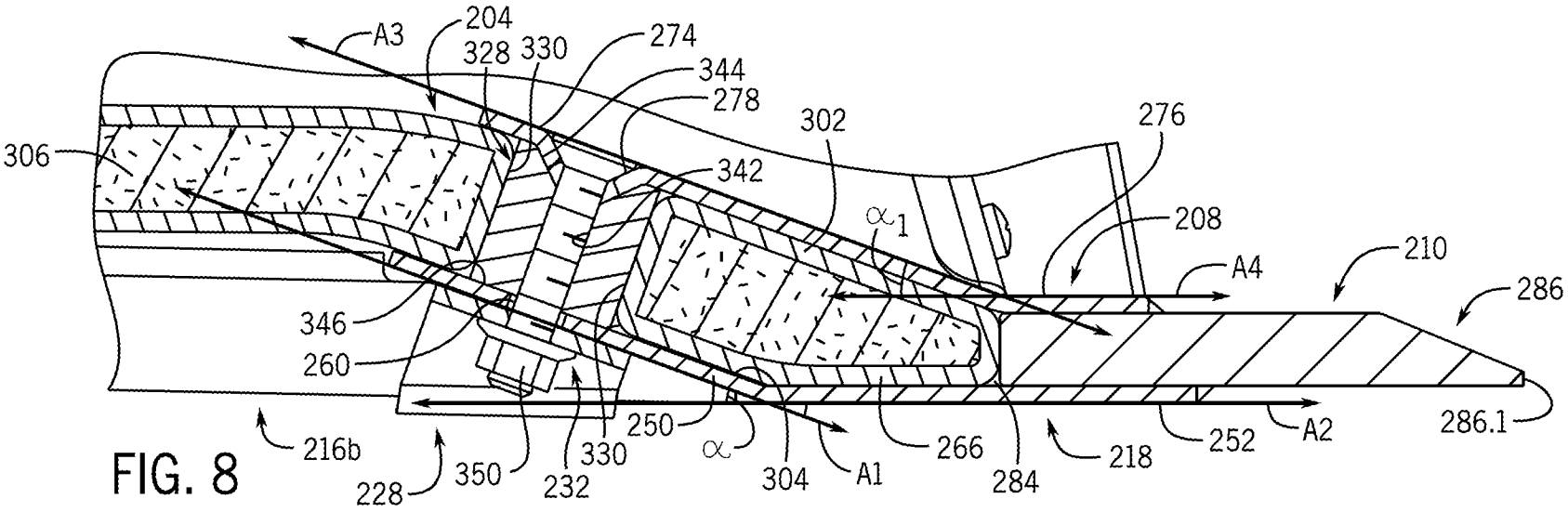
FIG. 8 is a cross-sectional view taken along line 8-8 in FIG. 3, which illustrates a leading edge of the bucket sandwiched between a portion of the reinforcing structure.

In one example, with reference to FIG. 5, the reinforcing structure 202 includes a frame 206, a second edge plate 208 (FIG. 4), a wear plate 210, a first wear strip 212 and a second wear strip 214. In one example, the frame 206 includes at least two support members 216, a first edge plate 218 and a pair of side mounting brackets 220. In this example, the frame 206 includes three support members 216*a*-216*c*. Each of the support members 216*a*-216*c* has a first end 222 and an opposite second end 224 (FIG. 4). The support members 216*a*-216*c* are sized and shaped to cooperate with the size and shape of the bucket 204, and in one example, the support members 216*a*-216*c* have a substantially C-shape. In one example, the support members 216*a*-216*c* are each substantially hollow rectangular tubes; however, the support members 216*a*-216*c* may be solid, if desired. The support members 216*a*-216*c* are composed of a metal or metal alloy, which is stamped, cast, forged, etc. The first end 222 of the support members 216*a*-216*c* is coupled to the bucket 204, and the second end 224 of the support members 216*a*-216*c* is coupled to the first edge plate 218 (FIG. 4) such that the support members 216*a*-216*c* extend from the first edge plate 218 to a top side of the bucket 204. In one example, the second end 224 includes a taper, such that the second end 224 is flush with a portion of the first edge plate 218 (FIG. 8).

Figure 9:
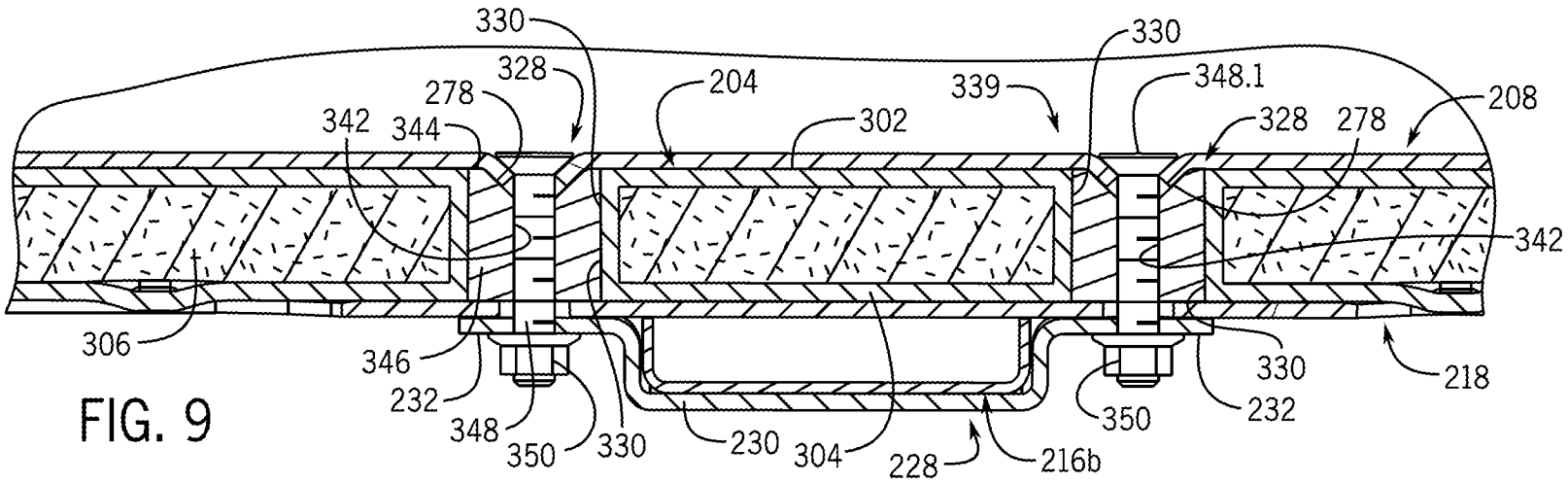
FIG. 9 is a cross-sectional view taken along line 9-9 in FIG. 3, which illustrates a support mounting feature associated with the bucket of the hybrid load bucket assembly of FIG. 3.

In one example, the first end 222 of each of the support members 216*a*-216*c* is coupled to the bucket 204 by a respective one of a plurality of mounting brackets 228, and the second end 224 of each of the support members 216*a*-216*c* is coupled to the first edge plate 218 by a respective one of the mounting brackets 228 (FIG. 4). The mounting brackets 228 are each composed of a metal or metal alloy, and may be cast, stamped, forged, etc. Each of the mounting brackets 228 has a body that defines a channel 230 and a pair of coupling flanges 232. The channel 230 receives the respective first end 222 or the second end 224. One of the coupling flanges 232 is on either side of the channel 230. As will be discussed, the coupling flanges 232 define one or more bores to receive one or more mechanical fasteners therethrough, such as screws, to couple the respective mounting bracket 228, and thus, the first end 222 of the respective support member 216*a*-216*c* to the bucket 204 and the second end 224 of the respective support member 216*a*-216*c* to the second edge plate 208 (FIG. 9). In one example, the coupling flanges 232 of the mounting brackets 228 associated with the first end 222 of the support members 216*a*-216*c* include two bores 232.1, 232.2 that each receive a respective mechanical fastener, such as the screw, to couple the mounting bracket 228 and the first end 222 of the support members 216*a*-216*c* to the bucket 204. The coupling flanges 232 of the mounting brackets 228 associated with the second end 224 of the support members 216*a*-216*c* include a single bore 232.1 that receives a mechanical fastener (FIG. 4), such as the screw, to couple the mounting bracket 228 and the second end 224 of the support members 216*a*-216*c* to the bucket 204. It should be noted, however, that the coupling flanges 232 may define any number of bores. Generally, each of the mechanical fasteners, such as the screws, may be secured with a nut or other device.

Figure 6:
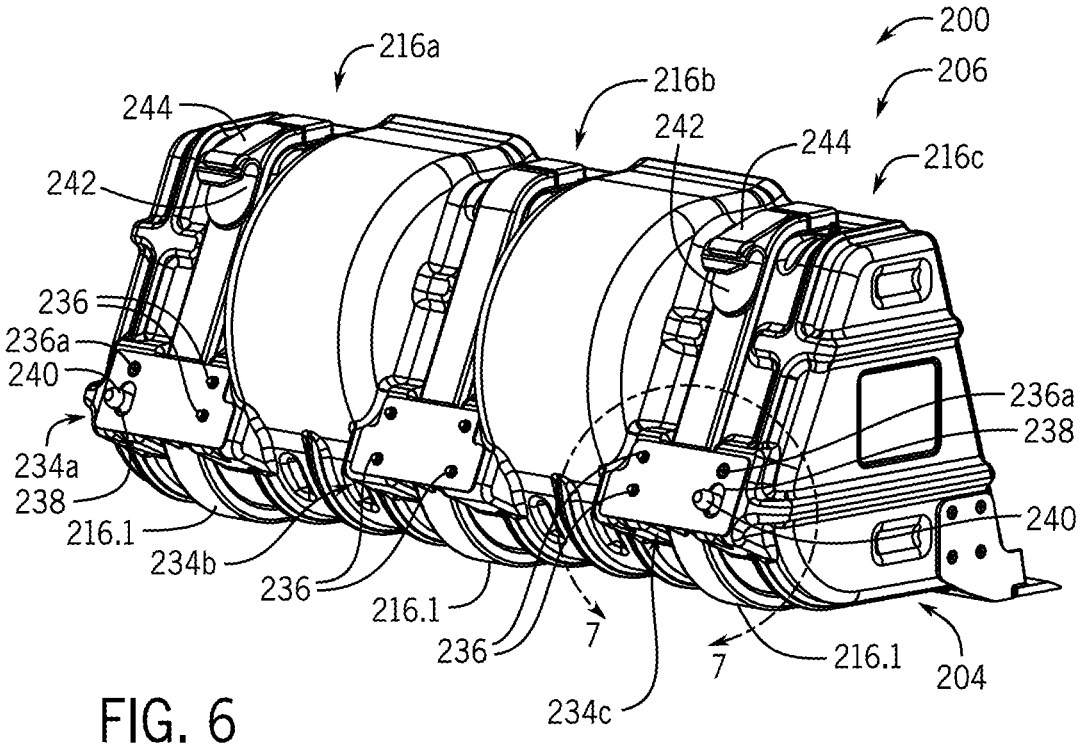
FIG. 6 is a rear perspective view of the hybrid load bucket assembly of FIG. 3.

With reference to FIG. 6, the support members 216*a*-216*c* also include a respective midsection support plate 234*a*-234*c*. The respective midsection support plate 234*a*-234*c* is coupled to each of the support members 216*a*-216*c* between the first end 222 and the second end 224. In one example, the respective midsection support plate 234*a*-234*c* is coupled to the respective support member 216*a*-216*c* proximate a curved section 216.1 of the respective support member 216*a*-216*c*. The respective midsection support plate 234*a*-234*c* further retains or couples the respective support member 216*a*-216*c* to the bucket 204. The midsection support plates 234*a*-234*c* are each composed of a metal or metal alloy, and may be cast, stamped, forged, etc.

Figure 7:
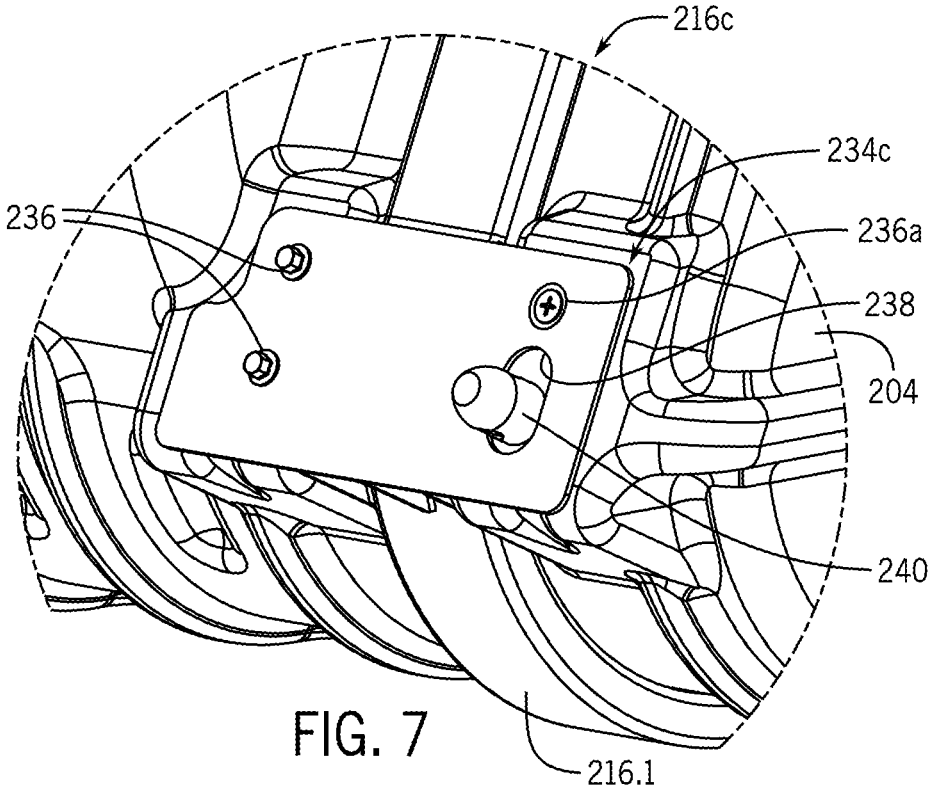
FIG. 7 is a detail view taken at 7-7 of FIG. 6, which illustrates a midsection support plate associated with one support member associated with the hybrid load bucket assembly of FIG. 9.

In one example, the midsection support plate 234*a* includes a plurality of bores 236, which receive one of more mechanical fasteners, such as bolts, screws, etc., to couple the midsection support plate 234*a* to the bucket 204. In one example, one bore 236*a* of the plurality of bores 236 is countersunk, such that a head of the mechanical fastener is flush with the midsection support plate 234*a*. In this example, the midsection support plate 234*a* is coupled to the bucket 204 with a pair of bolts and a screw, and the screw is received within the bore 236*a*. A head of the screw is substantially flush with the midsection support plate 234*a* to provide clearance for coupling the loader arm 64 to the bucket 204. The midsection support plate 234*a* also includes a locating slot 238. The locating slot 238 is defined with a substantially oval shape to be positioned about one of a pair of locating pins 240 defined on the bucket 204. The midsection support plate 234*b* includes the plurality of bores 236, which receive one of more mechanical fasteners, such as bolts, screws, etc., to couple the midsection support plate 234*b* to the bucket 204. In this example, the midsection support plate 234*b* is coupled to the bucket 204 with a plurality of bolts. The midsection support plate 234*c* is a mirror image of the midsection support plate 234*a*. With reference to FIG. 7, the midsection support plate 234*c* includes the plurality of bores 236, which receive one of more mechanical fasteners, such as bolts, screws, etc., to couple the midsection support plate 234*c* to the bucket 204. In one example, the midsection support plate 234*c* includes the one bore 236*a*, which is countersunk, such that a head of the mechanical fastener is flush with the midsection support plate 234*c*. In this example, the midsection support plate 234*c* is coupled to the bucket 204 with a pair of bolts and a screw, and the screw is received within the bore 236*a*. A head of the screw is substantially flush with the midsection support plate 234*c* to provide clearance for coupling the loader arm 62 to the bucket 204. The midsection support plate 234*c* also includes the locating slot 238. The locating slot 238 is defined with a substantially oval shape to be positioned about the other of the pair of locating pins 240 defined on the bucket 204.

In addition, with reference back to FIG. 6, at least two of the support members 216*a*-216*c*, in one example support members 216*a*, 216*c*, each include a mount upper hook or hooks 242 for coupling the HLBA 200 to the loader 10. In this example, the hooks 242 are coupled to the support members 216*a*, 216*c* by welding, however, one or more mechanical fasteners may be used. Moreover, the hooks 242 may be formed integrally with the support members 216*a*, 216*c*, if desired. Generally, the hooks 242 are composed of a metal or metal alloy, and are stamped, cast, forged, etc. The hooks 242 define a substantially U-shaped opening for coupling the HLBA 200 to the cross-rod 78 of the carrier 68 (FIG. 1). The hooks 242 are coupled to the support members 216*a*, 216*c* between the curved section 216.1 and the first end 222, and are generally proximate the first end 222. A reinforcement plate 244, which may be composed of metal or metal alloy, may be coupled between the hooks 242 and the respective support member 216*a*, 216*c* proximate the first end 222, via welding, for example, to provide additional strength to the hooks 242.

With reference to FIG. 4, the first edge plate 218 is coupled to the support members 216*a*-216*c*. As will be discussed, the first edge plate 218 protects a bottom of the bucket 204 near a leading edge of the bucket 204. The first edge plate 218 is composed of a metal or metal alloy, and may be stamped, cast, forged, etc. The first edge plate 218 extends from a first plate side 246 to a second plate side 248, and has a first plate end 250 opposite a second plate end 252. The first plate side 246 is coupled to one of the side mounting brackets 220, via welding, for example, and the second plate side 248 is coupled to another one of the side mounting brackets 220, via welding, for example. The first plate end 250 includes a plurality of recesses 254 and a pair of reliefs 256. The plurality of recesses 254 and the pair of reliefs 256 accommodate corresponding vertical ribs 258 defined on the bucket 204. The first plate end 250 also defines a first plurality of bores 260 and a second plurality of bores 262 through the first plate end 250 between the first plate side 246 and the second plate side 248. As will be discussed, the first plurality of bores 260 receive a mechanical fastener therethrough to couple the second ends 224 of the support members 216*a*-216*c* to the first edge plate 218. The second plurality of bores 262 couple the first edge plate 218 to the bucket 204.

With reference to FIG. 8, the first plate end 250 is also angled relative to the second plate end 252. Stated another way, the first plate end 250 has a first axis A1 and the second plate end 252 has a second axis A2, and the first axis A1 is spaced apart from the second axis A2 by an angle $\alpha$. In one example, the angle $\alpha$ is about 20 degrees to about 55 degrees. By angling the first plate end 250 relative to the second plate end 252, the tapered second ends 224 of the support members 216*a*-216*c* may be coupled to the first edge plate 218 such that the second ends 224 are substantially coplanar with the second plate end 252. As will be discussed, the second plate end 252 is coupled to the wear plate 210.

With reference to FIG. 5, the pair of side mounting brackets 220 are coupled to the first edge plate 218. The side mounting brackets 220 are each composed of a metal or metal alloy, and may be cast, stamped, forged, etc. One of the side mounting brackets 220 is coupled to the first plate side 246, and the other of the side mounting brackets 220 is coupled to the second plate side 248. The side mounting brackets 220 protect the side of the bucket 204 near a leading edge 266 of the bucket 204, and also further couple the first edge plate 218, the second edge plate 208 and the wear plate 210 to the bucket 204. In one example, the side mounting brackets 220 are coupled to the first edge plate 218, the second edge plate 208 and the wear plate 210 by welding, however, the side mounting brackets 220 may also be coupled to the first edge plate 218, the second edge plate 208 and the wear plate 210 by mechanical fasteners, etc. The side mounting brackets 220 include a plurality of bores 264 that each receives a mechanical fastener, such as a screw, to couple the side mounting bracket 220 to the bucket 204.

The second edge plate 208 cooperates with the first edge plate 218 to sandwich the leading edge 266 of the bucket 204 between the first edge plate 218 and the second edge plate 208 (FIG. 8). The second edge plate 208 is composed of a metal or metal alloy, and may be stamped, cast, forged, etc. The second edge plate 208 extends from a third plate side 270 to a fourth plate side 272, and has a third plate end 274 opposite a fourth plate end 276. The third plate side 270 is spaced apart from a lateral side of the bucket 204, and the fourth plate side 272 is spaced apart from another lateral side of the bucket 204. Generally, a portion of the second edge plate 208 is received within the bucket 204. The third plate end 274 defines a plurality of countersunk bores 278 through the third plate end 274 between the third plate side 270 and the fourth plate side 272. As will be discussed, with reference to FIG. 8, the plurality of countersunk bores 278 each receive a mechanical fastener therethrough, such as a screw or bolt, which is supported by a bushing to couple the second edge plate 208, the bucket 204, the first edge plate 218 and the coupling flanges 232 of the mounting brackets 228 that surround the second ends 224 of the support members 216*a*-216*c* together.

The third plate end 274 is also angled relative to the fourth plate end 276. Stated another way, the third plate end 274 has a third axis A3 and the fourth plate end 276 has a fourth axis A4, and the third axis A3 is spaced apart from the fourth axis A4 by an angle $\alpha_1$. In one example, the angle $\alpha_1$ is about 20 degrees to about 55 degrees. By angling the third plate end 274 relative to the fourth plate end 276, the leading edge 266 of the bucket 204 is positionable between the first edge plate 218 and the second edge plate 208. As will be discussed, the fourth plate end 276 is coupled to the wear plate 210.

The wear plate 210 is coupled to and sandwiched between the first edge plate 218 and the second edge plate 208. In one example, the wear plate 210 is coupled to the first edge plate 218 and the second edge plate 208 by welding; however, any technique may be used to couple the wear plate 210 to the first edge plate 218 and the second edge plate 208. The wear plate 210 is composed of a metal or metal alloy, and is cast, stamped, forged, etc. The wear plate 210 protects the leading edge 266 of the bucket 204. With reference to FIG. 5, the wear plate 210 has a first wear side 280 opposite a second wear side 282, and a first wear end 284 (FIG. 8) opposite a second wear end 286. The first wear side 280 is coupled to one of the side mounting brackets 220, via welding, for example. The second wear side 282 is coupled to the other one of the side mounting brackets 220, via welding, for example. With reference to FIG. 8, the first wear end 284 is positioned so as to be in contact with the leading edge 266 of the bucket 204. Stated another way, the wear plate 210 is coupled to the first edge plate 218 and the second edge plate 208 such that the first wear end 284 contacts the leading edge 266 of the bucket 204 to provide reinforcement for the leading edge 266. The second wear end 286 tapers to a cutting edge 286.1. The cutting edge 286.1 facilitates the loading of materials into the bucket 204.

With reference to FIG. 5, the first wear strip 212 is coupled to the bucket 204 opposite the second wear strip 214. The first wear strip 212 is a mirror image of the second wear strip 212. The first wear strip 212 and the second wear strip 214 include a first strip end 290 and an opposite second strip end 292. The first strip end 290 and the second strip end 292 each include a respective protrusion 290*a*, 290*b*; 292*a*, 292*b*, which protrudes inward toward an interior of the bucket 204. The protrusions 290*a*, 290*b*; 292*a*, 292*b* provide reinforcement at corners of the bucket 204. The first wear strip 212 and the second wear strip 214 each also define a plurality of bores 294 from the first strip end 290 to the second strip end 292. The plurality of bores 294 receive a respective mechanical fastener, such as a screw, to couple the first wear strip 212 and the second wear strip 214, respectively, to the bucket 204.

The bucket 204 defines a volume 300 for receiving materials. The bucket 204 is integrally formed and is a monolithic component. In one example, the bucket 204 is formed of a polymer-based material, including, but not limited to, polyethylene, nylon and polyamide. In one example, the bucket 204 is formed through rotational molding; however, other techniques may be employed. With brief reference to FIGS. 8 and 9, the bucket 204 is formed with a double-wall structure, having a first, inner wall 302 and an opposite second, outer wall 304. The double-wall structure has a thickness of about 22 millimeters (mm), and the bucket 204 has a weight of about 50 kilograms (kg) when filled with a fill material. In one embodiment, the double-wall structure of the bucket 204 is filled with a fill material 306 between the first, inner wall 302 and the second, outer wall 304. In one example, the fill material 306 is composed of a polymer-based foam, including, but not limited to, a polyethylene based foam and a polyurethane based foam. In this example, the fill material 306 may be injected during or after the rotational molding of the bucket 204. In other embodiments, the double-wall structure of the bucket 204 is hollow between the first, inner wall 302 and the second, outer wall 304 such that the double-wall structure is unfilled.

The bucket 204 includes a first or top side 310, a second or bottom side 312 opposite the top side 310, a third or rear side 314 and a pair of lateral sides 316. The top side 310 is formed integrally with the rear side 314 and the pair of lateral sides 316. The top side 310 has a first top side surface 318 opposite a second top side surface 320, a first top end surface 322 opposite a second top end surface 324. One of the lateral sides 316 is formed integrally with the first top side surface 318, and the other of the lateral sides 316 is formed integrally with the second top side surface 320. The first top end surface 322 is formed integrally with the rear side 314. The top side 310 includes a plurality of mounting features 326, which are spaced apart from the first top side 318 to the second top side 320. In one example, each of the mounting features 326 corresponds with one of the mounting brackets 228 for coupling the first end 222 of the respective support members 216*a*-216*c* to the bucket 204. In this example, each of the mounting features 326 includes a plurality of bushings 328, which are each in communication with a respective pair of a plurality of bores 330 defined through the inner wall 302 and the outer wall 304 of the bucket 204. Generally, for each mechanical fastener received through the bore 232.1 associated with the mounting bracket 228, the top side 310 includes one respective bushing 328 and a respective pair of bores 330. The bushings 328 enable the bucket 204 to withstand the torque applied while coupling the bucket 204 to the respective support members 216*a*-216*c* via the mechanical fasteners. Thus, in this example, each mounting feature 326 includes four bushings 328 and four pairs of bores 330, one for each of the four mechanical fasteners associated with one of the mounting brackets 228 as each coupling flange 232 of the mounting bracket 228 associated with the first end 222 in this example has two bores 232.1, 232.2 for receiving a respective mechanical fastener. Each of the bushings 328 are composed of a metal or metal alloy, and are stamped, cast, machined, forged, etc. The bushings 328 and the bores 330 are each formed integrally with the bucket 204.

Figure 10:
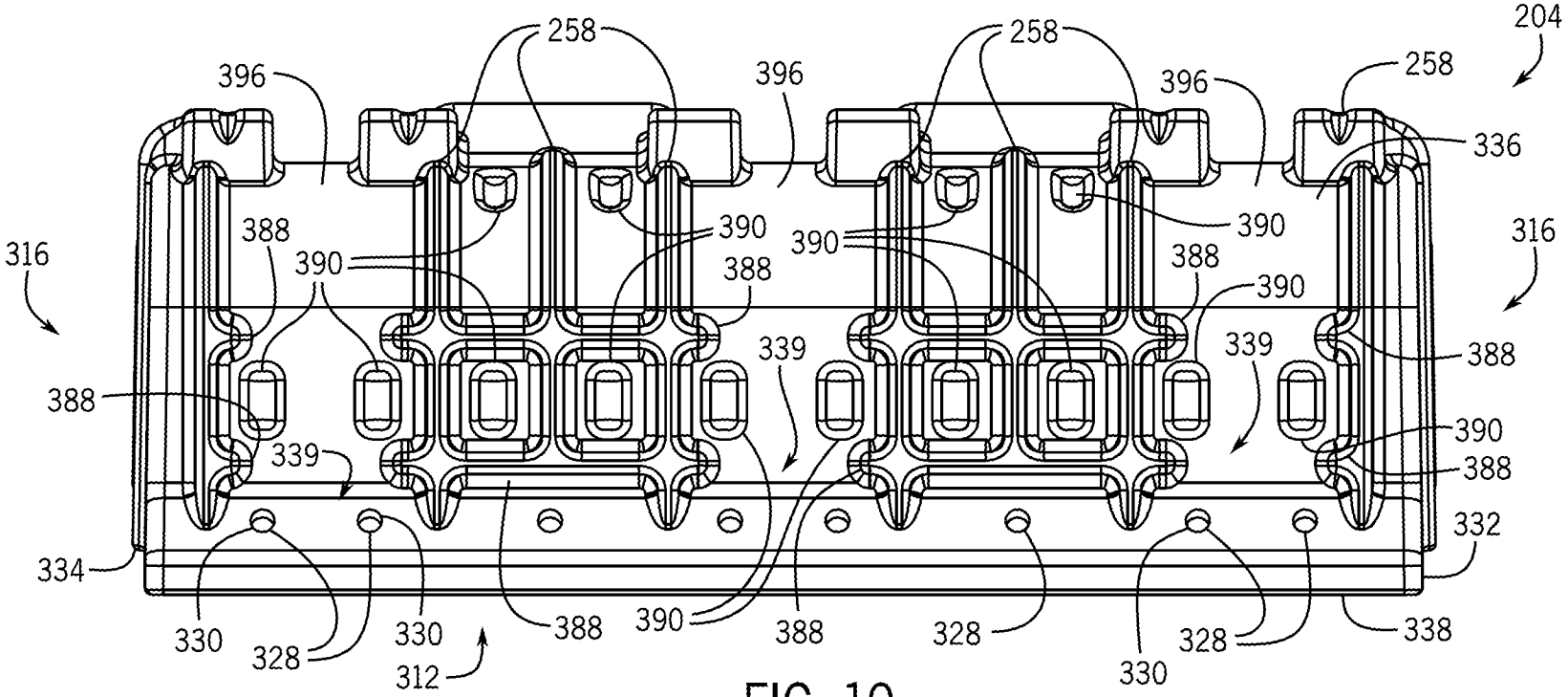
FIG. 10 is a bottom end view of the bucket of FIG. 3.

With reference to FIG. 10, the bottom side 312 has a first bottom side surface 332 opposite a second bottom side surface 334, a first bottom end surface 336 opposite a second bottom end surface 338. One of the lateral sides 316 is formed integrally with the first bottom side surface 332, and the other of the lateral sides 316 is formed integrally with the second bottom side surface 334. The first bottom end surface 336 is formed integrally with the rear side 314. The bottom side 312 includes a plurality of support mounting features 339 and a pair of plate mounting features 340. The plurality of support mounting features 339 are spaced apart from the first bottom side surface 332 to the second bottom side surface 334. In one example, each of the support mounting features 339 corresponds with one of the mounting brackets 228 for coupling the second end 224 of the respective support members 216*a*-216*c* to the bucket 204. In this example, each of the support mounting features 339 includes the plurality of bushings 328, which are each in communication with a respective pair of the plurality of bores 330 defined through the inner wall 302 and the outer wall 304 of the bucket 204. Generally, for each mechanical fastener received through the bore 232.1 associated with the mounting bracket 228, the bottom side 312 includes one respective bushing 328 and a respective pair of bores 330. Thus, in this example, each support mounting feature 339 includes two bushings 328 and two pairs of bores 330, one for each of the two mechanical fasteners associated with one of the mounting brackets 228 as each coupling flange 232 of the mounting bracket 228 associated with the second end 224 in this example has a single bore 232.1 for receiving a mechanical fastener.

With reference to FIG. 9, one of the support mounting features 339 is shown in greater detail. As shown, the support mounting feature 339 includes two bushings 328, which are integrally formed and sandwiched between the inner wall 302 and the outer wall 304. The bushings 328 each include a central bore 342, which extends from a first bushing end 344 to an opposite second bushing end 346. The central bore 342 is coaxially aligned with the respective pair of bores 330 for receipt of a mechanical fastener 348. At the first bushing end 344, the central bore 342 is countersunk to cooperate with the countersunk bore 278 of the second edge plate 208. As shown, the mechanical fasteners 348 are positioned within and through the countersunk bores 278 such that a head 348.1 of the mechanical fastener 348 is flush with the second edge plate 208. This inhibits material within the bucket 204 from accumulating about the head 348.1 of the mechanical fastener 348. As will be discussed, the mechanical fasteners 348 are inserted through the countersunk bores 278 so as to extend through the central bore 342 of the respective bushing 328, through the bore 232.1 of the mounting brackets 228 and are secured with a nut 350, for example.

With reference to FIG. 5, the bottom side 312 includes two plate mounting features 340. The plate mounting features 340 each include a respective bushing 328, which is associated with a respective pair of bores 330 defined through the inner wall 302 and the outer wall 304 of the bucket 204. The bushing 328 receives a mechanical fastener to couple the second edge plate 208 to the bucket 204 (FIG. 4). In one example, the mechanical fastener may be secured with the nut 350 (FIG. 4).

With reference to FIG. 10, the rear side 314 has a first rear side surface 352 opposite a second rear side surface 354, a first rear end surface 356 opposite a second rear end surface 358. One of the lateral sides 316 is formed integrally with the first rear side surface 352, and the other of the lateral sides 316 is formed integrally with the second rear side surface 354. The first rear end surface 356 is formed integrally with the top side 310, and the second rear end surface 358 is formed integrally with the bottom side 312. The rear side 314 includes a plurality of midsection mounting features 360*a*-360*c*. The plurality of midsection mounting features 360*a*-360*c* is spaced apart from the first rear side surface 352 to the second rear side surface 354. In one example, each of the midsection mounting features 360*a*-360*c* corresponds with one of the midsection support plates 234*a*-234*c* for coupling the midsection support plates 234*a*-234*c* to the bucket 204. In this example, each of the midsection mounting features 360*a*-360*c* includes a plurality of threaded inserts 362, which are each in communication with a bore 364 defined through the outer wall 304 of the bucket 204. Each of the threaded inserts 362 define a central bore 362.1 that has a plurality of internal threads, which matingly engage with a respective mechanical fastener, such as a screw or bolt. The central bore 362.1 is in communication with and coaxially aligned with the respective bore 364 defined through the outer wall 304 to receive the mechanical fastener. Each of the threaded inserts 362 are composed of a metal or metal alloy, and are formed integrally with the bucket 204.

One of the threaded inserts 362 of the midsection mounting features 360*a*, 360*c* may have a larger diameter than a remainder of the threaded inserts 362 for receipt of the screw for coupling the midsection support plates 234*a*, 234*c* to the bucket 204. The midsection mounting features 360*a*, 360*c* also include a respective one of the locating pins 240. The locating pins 240 are composed of a metal or metal alloy, and are formed integrally with the bucket 204. Each of the locating pins 240 includes a cross-bore, which receives a pin to couple the HLBA 200 to the respective coupler 74, 76, and thus, the respective loader arm 62, 64 (FIG. 10). It should be noted that while the locating pins 240 are illustrated herein as being integrally formed with the bucket 204, in certain embodiments, the locating pins 240 may be integrally formed with or coupled to a portion of the reinforcing structure 202.

The pair of lateral sides 316 is formed integrally with the top side 310, the bottom side 312 and the rear side 314 to define the volume 300. Each of the lateral sides 316 includes a first side surface 370 opposite a second side surface 372, and a first end surface 374 opposite a second end surface 376. The first side surface 370 is formed integrally with the top side 310, and the second side surface 372 is formed integrally with the bottom side 312. The first end surface 374 is formed integrally with the rear side 314. The second end surface 376 includes a plurality of mounting receptacles 378. The plurality of mounting receptacles 378 are spaced apart from the first side surface 370 to the second side surface 372. In one example, each of the mounting receptacles 378 corresponds with one of the bores 294 of the respective one of the first wear strip 212 or second wear strip 214 for coupling the first wear strip 212 or second wear strip 214 to the respective lateral side 316 of the bucket 204. In this example, each of the mounting receptacles 378 includes one of the threaded inserts 362, which are each in communication with a respective bore 380 defined through the bucket 204. The central bore 362.1 is in communication with and coaxially aligned with the respective bore 380 defined through the bucket 204 to receive the mechanical fastener.

Figure 12:
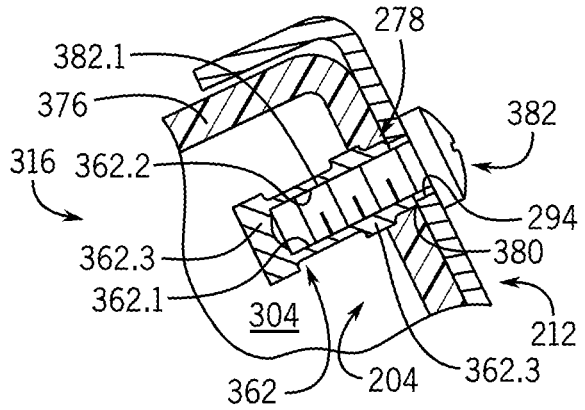
FIG. 12 is a detail view taken at 12-12 of FIG. 3, which illustrates a threaded insert associated with the bucket of FIG. 3.

With reference to FIG. 12, one of the mounting receptacles 378 is shown in greater detail. As shown, the threaded insert 362 is formed integrally with the second end surface 376, so as to be in communication with the bore 380 defined through the second end surface 376. The central bore 362.1 of the threaded insert 362 includes a plurality of threads 362.2, which matingly engage with a plurality of threads 382.1 defined on a mechanical fastener 382. The respective bore 294 of the first wear strip 212 is coaxially aligned with the bore 380 and the central bore 362.1 of the threaded insert 362 to receive the mechanical fastener 382. In this example, the mechanical fastener 382 is a bolt; however, any suitable fastener may be used. It should be noted that in certain embodiments the threaded insert 362 may include one or more flanges 362.3 that assist in integrally forming the threaded insert 362 with the bucket 204.

Figure 13:
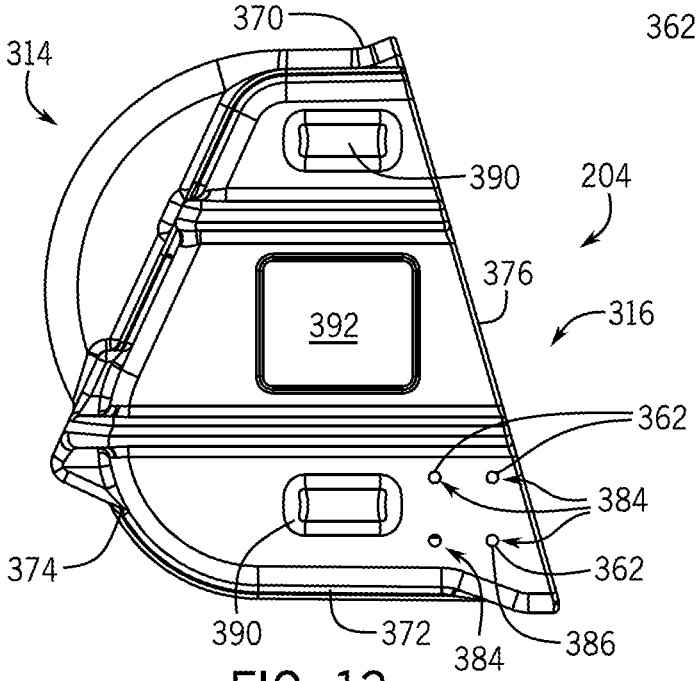
FIG. 13 is a side view of the bucket of FIG. 3.

With reference to FIG. 13, each of the lateral sides 316 also includes a plurality of side bracket mounting features 384 proximate the second side surface 372 and the second end surface 376. In one example, each of the side bracket mounting features 384 includes one of the threaded inserts 362, which is in communication with a bore 386 defined through the outer wall 304 of the respective lateral side 316. In this example, each of the lateral sides 316 includes four of the side bracket mounting features 384, which cooperate with a respective one of the bores 264 of the respective side mounting bracket 220 to couple the respective side mounting bracket 220 to the bucket 204. Each of the side bracket mounting features 384 receive a respective mechanical fastener, such as a bolt, to couple the side mounting bracket 220 to the bucket 204 (FIG. 6).

Figure 11:
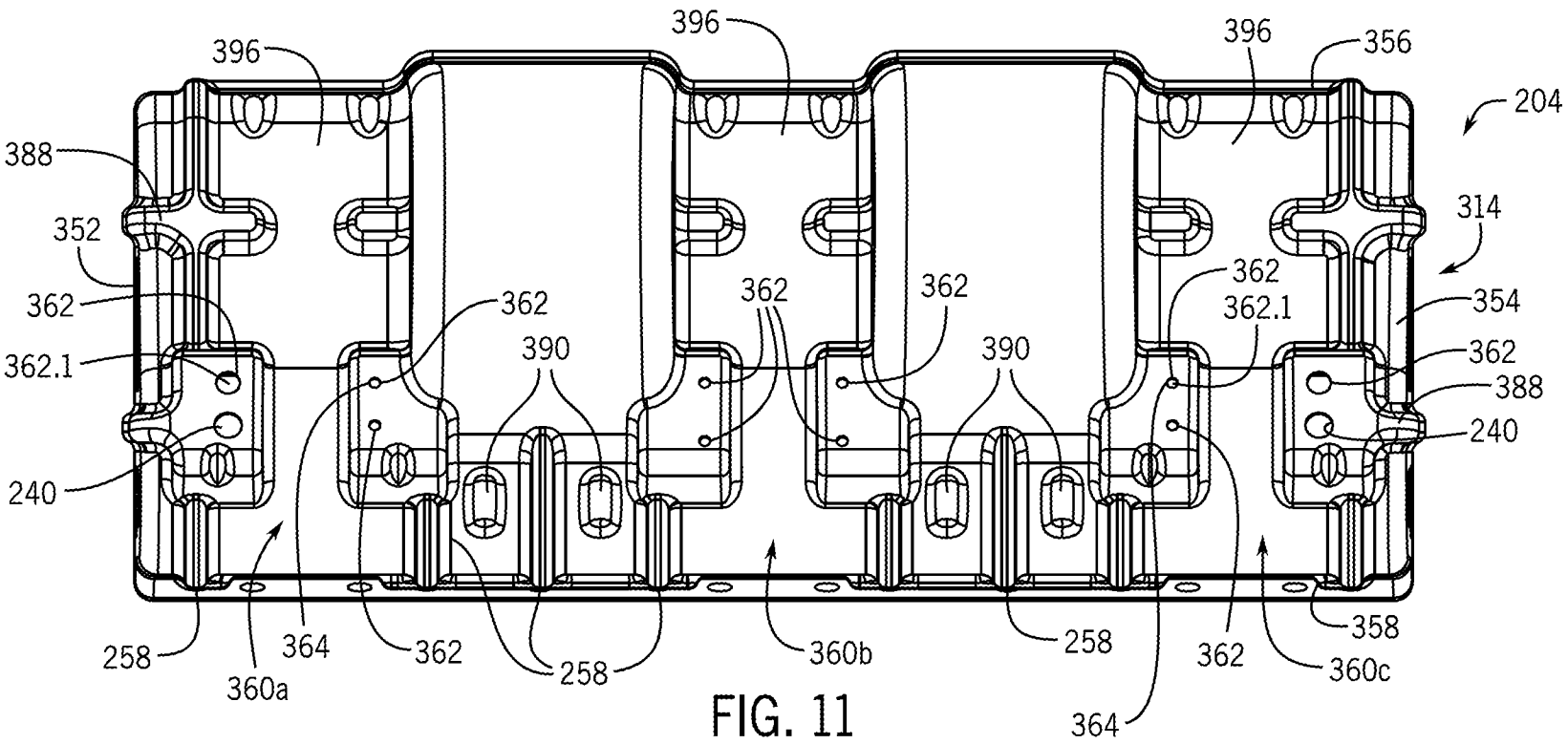
FIG. 11 is a rear end view of the bucket of FIG. 3.

The bucket 204 also includes the plurality of vertical ribs 258, a plurality of horizontal ribs 388, one or more kiss-off areas 390, one or more decals 392 and one or more increased volume cavities 394. With reference to FIGS. 10 and 11, the vertical ribs 258 are spaced apart between the lateral sides 316 to impart additional rigidity to the bucket 204. Generally, the vertical ribs 258 extend from the top side 310 to the bottom side 312. The vertical ribs 258 and the horizontal ribs 388 may be interrupted by the one or more increased volume cavities 394. In addition, each of the vertical ribs 258 and the horizontal ribs 388 may be interrupted to define channels 396 for each of the support members 216*a*-216*c*. The horizontal ribs 388 extend from one of the lateral sides 316 to the other of the lateral sides 316 along the rear side 314 and bottom side 312. The horizontal ribs 388 generally intersect one or more of the vertical ribs 258. It should be noted that the number, location and the size of the vertical ribs 258 and the horizontal ribs 388 illustrated herein is merely exemplary, as the bucket 204 may include any number of vertical ribs 258 and horizontal ribs 388 defined at any pre-determined location and having any pre-determined size that corresponds to a pre-determined stiffness for the bucket 204.

The kiss-off areas 390 are positioned at predetermined locations about the bucket 204 for increased stiffness. Each kiss-off area 390 is an area of the bucket 204 in which the inner wall 302 touches and is in contact with the outer wall 304 such that no void exists between the inner wall 302 and the outer wall 304. In one example, the kiss-off areas 390 are spaced apart along the bottom side 312, and one or more of the kiss-off areas 390 intersect one or more of the vertical ribs 258 and the horizontal ribs 388. In addition, the kiss-off areas 390 are defined along the rear side 314, and along the lateral sides 316 (FIG. 13). It should be noted that the number, location and the size of the kiss-off areas 390 illustrated herein is merely exemplary, as the bucket 204 may include any number of kiss-off areas 390 defined at any pre-determined location and having any pre-determined size that corresponds to a pre-determined stiffness for the bucket 204.

With reference to FIG. 13, in this example, the bucket 204 includes two decals 392, one defined on each of the lateral sides 316. The decals 392 include at least one of a color, symbol, alphanumeric character and combinations thereof. The decals 392 are formed integrally with the bucket 204 and visually indicate one or more attributes of the bucket 204, including, but not limited to, a manufacturer of the bucket 204, a warning label associated with the use of the bucket 204, etc. It should be noted that the decal 392 may be integrally formed at any desired location on the bucket 204.

With reference to FIG. 5, in this example, the bucket 204 includes two increased volume cavities 394. Each of the increased volume cavities 394 expand a carrying capacity of the bucket 204. In this example, the increased volume cavities 394 are defined between a respective pair of the support members 216*a*-216*c*, and are formed to extend outward from the rear side 314. The increased volume cavities 394 are substantially concave; however, the increased volume cavities 394 may have any desired shape.

With reference to FIG. 5, in order to form the HLBA 200, in one example, the bucket 204 is integrally formed of a polymer-based material through a forming process, such as rotational molding. The bucket 204 is formed integrally with the bushings 328, the threaded inserts 362 and the associated bores 330, 380, 386. The bucket 204 is also formed integrally with the vertical ribs 258, the horizontal ribs 388 and the kiss-off areas 390, which each increase a strength of the bucket 204. The bucket 204 is formed integrally with the decals 392. The bucket 204 is formed integrally with the double-wall structure, which includes the inner wall 302 and the outer wall 304. In one example, the double-wall structure is filled with the fill material 306 during or after forming, to increase a stiffness of the bucket 204. The increased volume cavities 394 are also formed integrally with the bucket 204.

With the bucket 204 formed, the reinforcing structure 202 is coupled to the bucket 204. In one example, the second edge plate 208 is positioned along the outer wall 304 of the leading edge 266 of the bucket 204, and the first edge plate 218 is positioned along the inner wall 302 of the leading edge 266 such that the leading edge 266 is sandwiched between the first edge plate 218 and the second edge plate 208. The support members 216*a*-216*c*, with the hooks 242 coupled to the support members 216*a*, 216*c*, are positioned about the bucket 204, and the mounting brackets 228 are positioned about the first ends 222 and the second ends 224 of the support members 216*a*-216*c*. Mechanical fasteners are inserted through the coupling flanges 232 of the mounting brackets 228 and through the bushings 328 formed integrally with the bucket 204 to couple the support members 216*a*-216*c*, the first edge plate 218 and the second edge plate 208 to the bucket 204. The midsection support plates 234*a*-234*c* are positioned over the respective support members 216*a*-216*c* such that the locating pin 240 (FIG. 6) passes through the locating slot 238 of the midsection support plates 234*a*, 234*c*. Mechanical fasteners are inserted through the bores 236 of the midsection support plates 234*a*-234*c* to matingly engage with the threaded inserts 362 to couple the midsection support plates 234*a*-234*c* to the bucket 204. The wear plate 210 is inserted between the first edge plate 218 and the second edge plate 208. The side mounting brackets 220 are coupled to the side bracket mounting features 384. Mechanical fasteners are positioned through the bores 264 of the side mounting brackets 220 to matingly engage with the threaded inserts 362 of the side bracket mounting features 384 to couple the side mounting brackets 220 to the bucket 204. The wear plate 210 is coupled to the first edge plate 218 and the second edge plate 208, via welding, for example, and the side mounting brackets 220 are coupled to the wear plate 210, via welding, for example. It should be noted that the wear plate 210 may be welded to the first edge plate 218, the second edge plate 208 and the side mounting brackets 220 to form a subassembly, which is coupled to the bucket 204. With the reinforcing structure 202 coupled to the bucket 204, pins may be positioned through the cross-bore of the locating pins 240 to couple the HLBA 200 to the respective coupler 74, 76, and thus, the respective loader arm 62, 64 (FIG. 1) or the loader arms 1262, 1264 of the front loader 1202 associated with the compact utility tractor 1200 (FIG. 1A).

Figure 14:
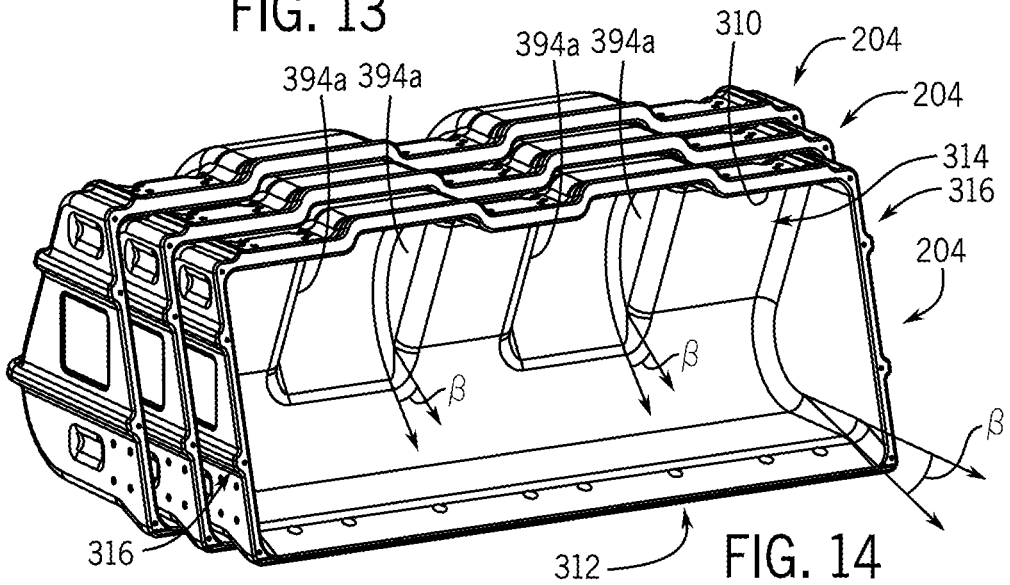
FIG. 14 is a perspective view that illustrates that a plurality of the buckets of FIG. 3 with the reinforcing structure removed such that the buckets are stackable for shipping and transport.

As the reinforcing structure 202 is coupled to the bucket 204 via mechanical fasteners, which are removable, if the bucket 204 becomes damaged or worn, the bucket 204 may be easily replaced by removing it from the reinforcing structure 202 and coupling the reinforcing structure 202 to another bucket 204. Moreover, the removable nature of the reinforcing structure 202 improves a packaging and shipping of the bucket 204. For example, with reference to FIG. 14, the buckets 204 are able to be shipped with the reinforcing structure 202 removed. In this example, the buckets 204 are formed with a draft angle β between each of the lateral sides 316 and the bottom side 312, and the draft angle β between each side 394*a* of the increased volume cavities 394 and the bottom side 312, which enables the buckets 204 to be stacked or nested together. In one example, the draft angle β ranges from greater than 0 degrees to about 10 degrees. The draft angle β creates an angle between the lateral sides 316 and the bottom side 312, and the sides 394*a* and the rear side 314, which provides clearance for stacking the buckets 204 within each other. By stacking or nesting the buckets 204 together, a larger quantity of buckets 204 may be transported by a transportation vehicle. This reduces shipping costs associated with the buckets 204. The reinforcing structure 202 may then be coupled to the buckets 204 upon delivery of the buckets 204 to the purchaser.

It should be noted that the HLBA 200 described with regard to FIGS. 1-14 may be configured differently to move and carry materials. In one example, with reference to FIGS. 15 and 16, a HLBA 400 is shown. As the HLBA 400 includes components that are substantially similar to or the same as the HLBA 200 discussed with regard to FIGS. 1-14, the same reference numerals will be used to denote the same or similar features. In this example, the HLBA 400 includes the reinforcing structure 202, the bucket 204 and a divider system 402. The HLBA 400 is configured to be coupled to the loader arms 62, 64 of the loader 10 (FIG. 1) or the loader arms 1262, 1264 of the front loader 1202 associated with the compact utility tractor 1200 (FIG. 1A). The divider system 402 is received within the bucket 204 so as to divide the volume 300 of the bucket 204 into multiple compartments. The divider system 402 may be removably coupled to the bucket 204. In this example, the divider system 402 includes a plurality of dividers or divider panels 404 and a rod system 406. The divider panels 404 have a shape that corresponds to the bucket 204, and in one example, each divider panel 404 is shaped similar to the lateral side 316. Each divider panel 404 is composed of a metal, metal alloy or polymer, and may be formed by casting, stamping, forging, molding, etc. Each divider panel 404 includes a bore 408. In one example, with reference to FIG. 17, the bore 408 is countersunk on either end to define an internal flange 408.1. The internal flange 408.1 extends radially inward and cooperates with the rod system 406 to couple the respective divider panel 404 to the rod system 406. In this example, the divider system 402 includes three divider panels 404; however, the divider system 402 may include any number of divider panels 404.

Figure 16:
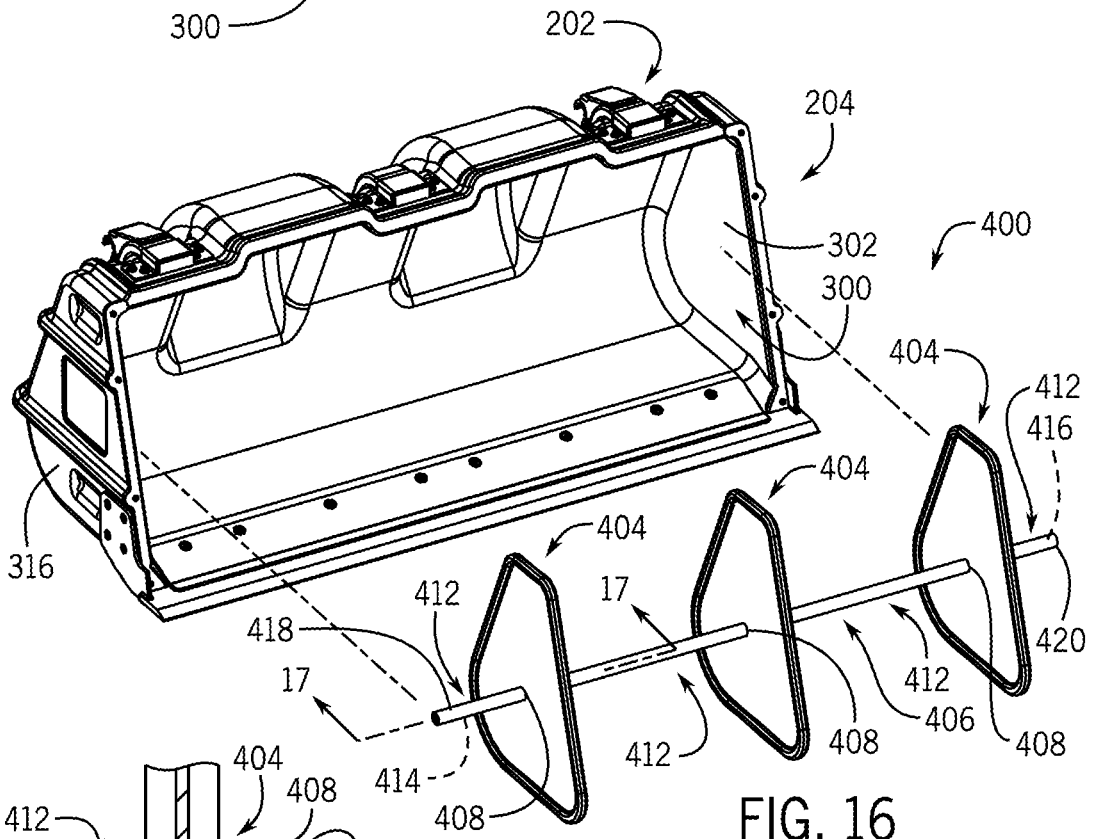
FIG. 16 is a partially exploded view of the hybrid load bucket assembly of FIG. 15.
Figure 17:
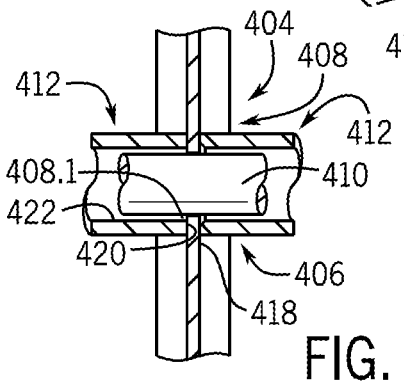
FIG. 17 is a cross-sectional view taken along line 17-17 of FIG. 16, which illustrates a portion of the divider system.

With reference to FIGS. 16 and 17, the rod system 406 interconnects the divider panels 404 such that the divider panels 404 move in unison as a single unit. In one example, the rod system 406 includes an inner rod 410 and a plurality of outer rods 412. The inner rod 410 is received through the bore 408 of each of the divider panels 404, and has a first rod end 414 opposite a second rod end 416. The first rod end 414 extends a distance beyond one of the divider panels 404 to contact the inner wall 302 of one of the lateral sides 316. The second rod end 416 extends a distance beyond one of the divider panels 404 to contact the inner wall 302 of the other one of the lateral sides 316. The inner rod 410 is composed of a metal, metal alloy or polymer, and may be cast, forged, extruded, etc. The inner rod 410 may be a solid rod, or may be hollow.

The outer rods 412 enclose the inner rod 410. In one example, the outer rods 412 extend between adjacent divider panels 404. Thus, in this example, the rod system 406 includes four outer rods 412. Each of the outer rods 412 has a first outer end 418, an opposite second outer end 420, and defines a bore 422 from the first outer end 418 to the second outer end 420. For the outer rods 412 that extend between adjacent divider panels 404, the first outer end 418 is adjacent to and in contact with the internal flange 408.1 of one of the divider panels 404 and the second outer end 420 is adjacent to and in contact with the internal flange 408.1 of the other one of the divider panels 404. The outer rods 412 are each composed of a metal, metal alloy or polymer, and may be cast, forged, extruded, etc. The respective first outer end 418 and the second outer end 420 of the outer rods 412 that are adjacent to or in contact with the respective internal flange 408.1 of the divider panels 404 may be secured to the respective internal flange 408.1 via welding, adhesives, mechanical fasteners, etc.

In order to assemble the divider system 402, with the divider panels 404 formed, the outer rods 412 are coupled to the divider panels 404. In one example, one of the outer rods 412 is coupled to the internal flange 408.1 of a first one of the divider panels 404 to extend toward the outer wall 304 of one of the lateral sides 316. A second one of the outer rods 412 is coupled to the internal flange 408.1 of the first one of the divider panels 404 to extend from the first one of the divider panels 404 to the internal flange 408.1 of a second adjacent one of the divider panels 404. A third one of the outer rods 412 is coupled to the internal flange 408.1 of the second one of the divider panels 404 to extend from the second one of the divider panels 404 to the internal flange 408.1 of a third adjacent one of the divider panels 404. A fourth one of the outer rods 412 is coupled to the internal flange 408.1 of the third one of the divider panels 404 to extend toward the outer wall 304 of the other one of the lateral sides 316. With the outer rods 412 coupled to the divider panels 404, the inner rod 410 is inserted through the bore 422 of the outer rods 412 and the bores 408 defined in the divider panels 404. With the divider system 402 assembled, the divider system 402 may be positioned within the bucket 204 to divide the volume 300 into multiple compartments.

Figure 15:
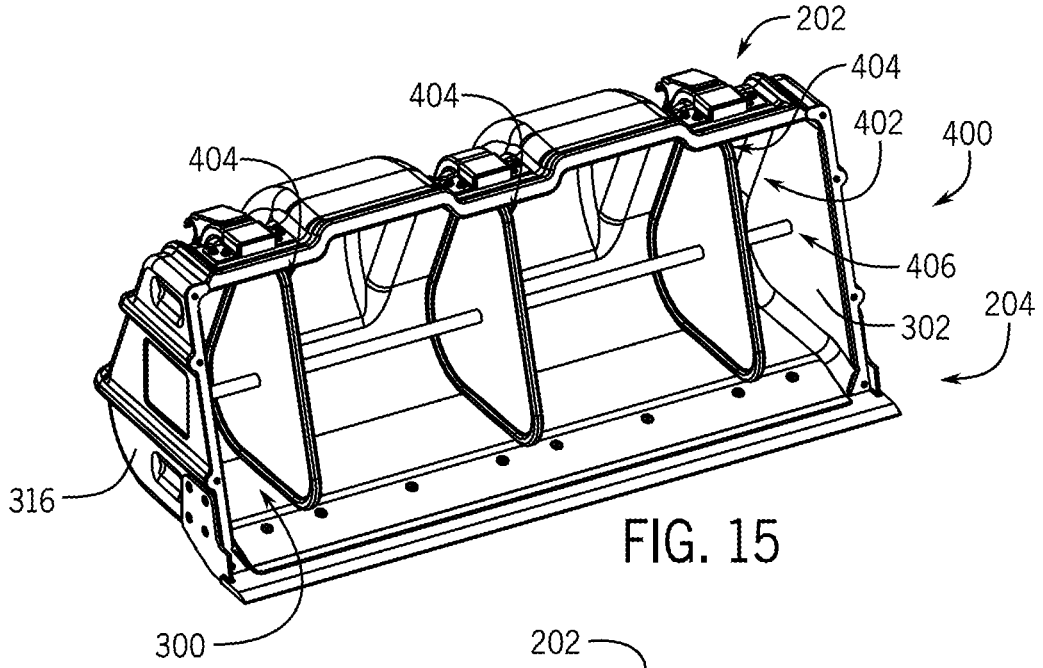
FIG. 15 is a perspective view of another hybrid load bucket assembly, which includes a reinforcing structure, a bucket and a divider system that divides a volume of the bucket into multiple compartments.
Figure 18:
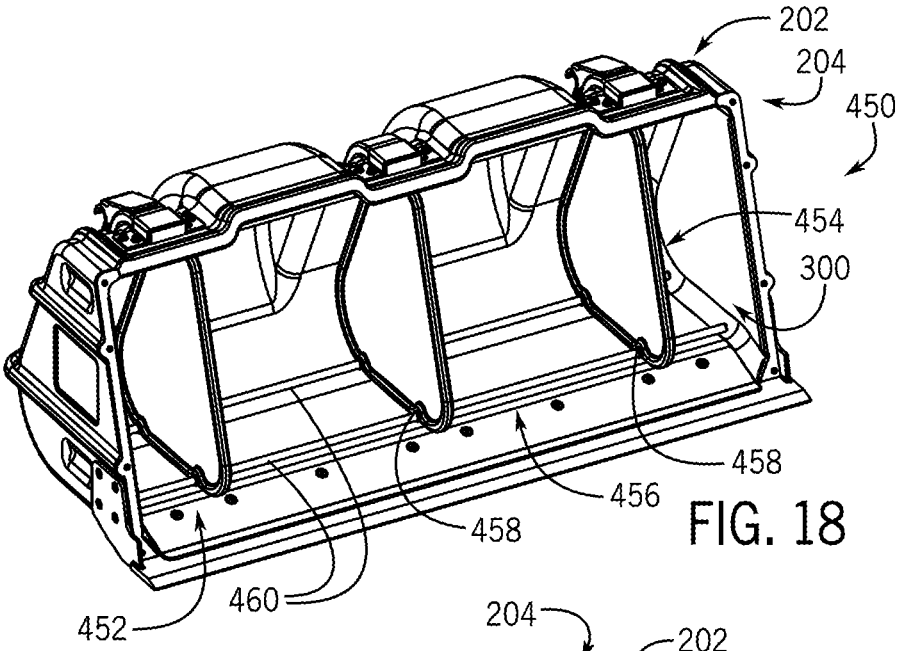
FIG. 18 is a perspective view of another hybrid load bucket assembly, which includes a reinforcing structure, a bucket and a divider system that divides a volume of the bucket into multiple compartments.

It should be noted that the divider system 402 described with regard to FIGS. 15-17 may be configured differently to divide the volume 300 of the bucket 204 into multiple compartments. In one example, with reference to FIGS. 18 and 19, a HLBA 450 is shown. As the HLBA 450 includes components that are substantially similar to or the same as the HLBA 200 discussed with regard to FIGS. 1-14, the same reference numerals will be used to denote the same or similar features. In this example, the HLBA 450 includes the reinforcing structure 202, the bucket 204 and a divider system 452. The HLBA 450 is configured to be coupled to the loader arms 62, 64 of the loader 10 (FIG. 1) or the loader arms 1262, 1264 of the front loader 1202 associated with the compact utility tractor 1200 (FIG. 1A). The divider system 452 is received within the bucket 204 so as to divide the volume 300 of the bucket 204 into multiple compartments. The divider system 452 may be removably coupled to the bucket 204. In this example, the divider system 452 includes a plurality of dividers or divider panels 454 and a rod system 456. The divider panels 454 have a shape that corresponds to the bucket 204, and in one example, each divider panel 454 is shaped similar to the lateral side 316. Each divider panel 454 is composed of a metal, metal alloy or polymer, and may be formed by casting, stamping, forging, molding, etc. Each divider panel 454 includes at least one notch 458. In one example, each divider panel 454 includes three notches 458. Each of the notches 458 cooperates with the rod system 456 to couple the rod system 456 to the divider panels 454. With reference to FIG. 20, each of the notches 458 is defined within a perimeter of the respective divider panel 454, and is substantially U-shaped. In this example, each of the divider panels 454 include one notch 458 along a first panel end 454.1 and two notches 458 along an opposite second panel end 454.2. In this example, the divider system 402 includes three divider panels 454; however, the divider system 452 may include any number of divider panels 454.

Figure 19:
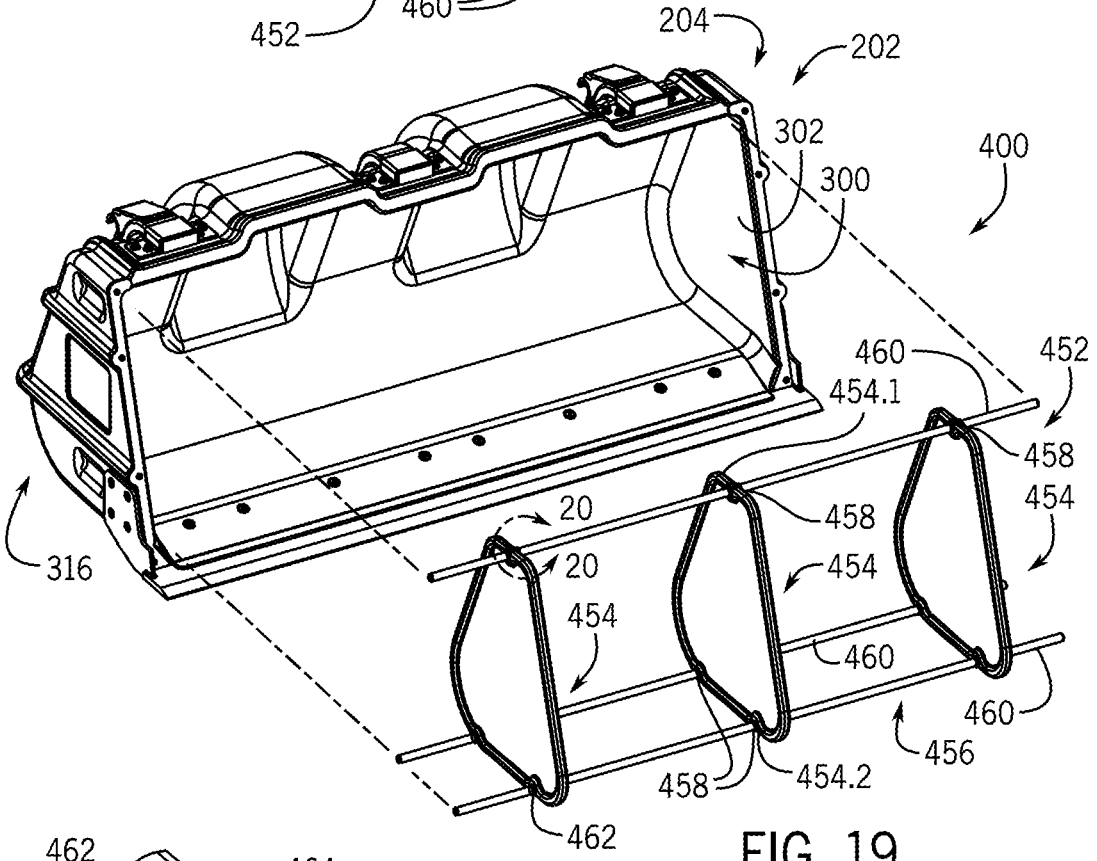
FIG. 19 is a partially exploded view of the hybrid load bucket assembly of FIG. 18.
Figure 20:
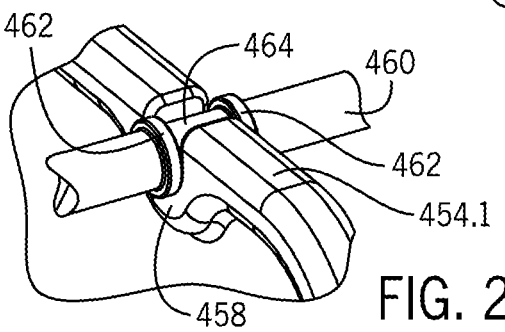
FIG. 20 is a detail view taken at 20-20 of FIG. 19, which illustrates a portion of the divider system.

With reference to FIGS. 19 and 20, the rod system 456 interconnects the divider panels 454. In one example, the rod system 456 includes three rods 460. Each of the rods 460 is received within and coupled to a respective one of the notches 458 of each of the divider panels 454. With reference to FIG. 20, each of the rods 460 includes a plurality of annular flanges 462, which cooperate to define a plurality of channels 464. In this example, each of the rods 460 includes three channels 464, with one channel 464 for each of the divider panels 454. The channels 464 are defined such that the rod 460 is snap-fit into the respective notch 458 of the respective divider panel 454 to couple the rod 460 to the divider panels 454. The rods 460 are each composed of a metal, metal alloy or polymer, and may be cast, forged, extruded, etc. The rods 460 are solid, but in certain examples, the rods 430 may be hollow.

In order to assemble the divider system 452, with the divider panels 454 formed, the rods 460 are coupled to the divider panels 454. In one example, one of the rods 460 is snap-fit into the notches 458 that are defined on the first panel end 454.1 of the divider panels 454. A second one of the rods 460 is snap-fit into the notches 458 that are defined on the second panel end 454.2 of the divider panels 454 at one side of the divider panels 454, and a third one of the rods 460 is snap-fit into the notches 458 that are defined on the first panel end 454.1 of the divider panels 454 at the other side of the divider panels 454. With the divider system 452 assembled, the divider system 452 may be positioned within the bucket 204 to divide the volume 300 into multiple compartments.

Figure 21:
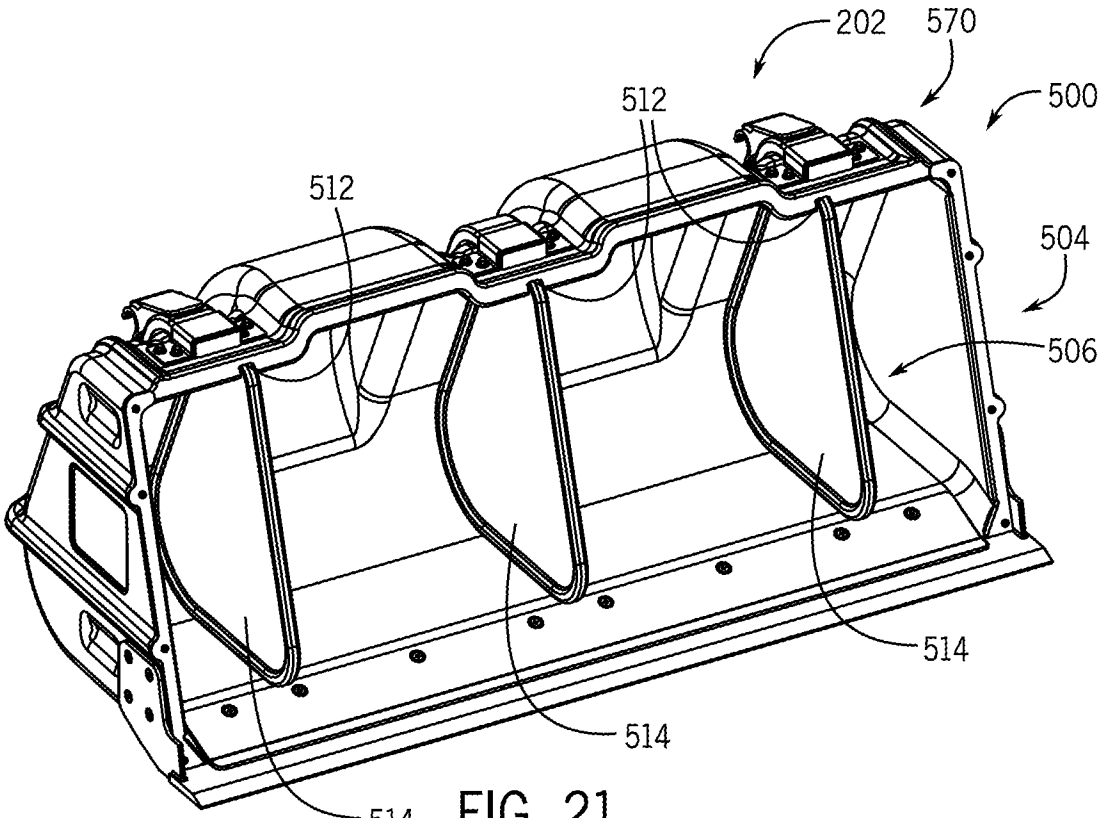
FIG. 21 is a perspective view of another hybrid load bucket assembly, which includes a reinforcing structure, a bucket and a divider system that divides a volume of the bucket into multiple compartments.

It should be noted that the divider system 402 described with regard to FIGS. 15-17 may be configured differently to divide the volume 300 of the bucket 204 into multiple compartments. In one example, with reference to FIG. 21, a HLBA 500 is shown. As the HLBA 500 includes components that are substantially similar to or the same as the HLBA 200 discussed with regard to FIGS. 1-14 and the HLBA 400 described with regard to FIGS. 15-17, the same reference numerals will be used to denote the same or similar features. In this example, the HLBA 500 includes the reinforcing structure 202, a bucket 504 and a divider system 506. The HLBA 500 is configured to be coupled to the loader arms 62, 64 of the loader 10 (FIG. 1) or the loader arms 1262, 1264 of the front loader 1202 associated with the compact utility tractor 1200 (FIG. 1A). The divider system 506 is received within the bucket 504 so as to divide the volume 300 of the bucket 504 into multiple compartments.

As the bucket 504 is substantially the same as the bucket 204 discussed with regard to FIGS. 1-14, the differences between the bucket 504 and the bucket 204 will be discussed herein, with the understanding that the remainder of the bucket 504 is the same as the bucket 204. The bucket 504 is integrally formed and is a monolithic component. Generally, like the bucket 204, the bucket 504 is integrally formed of a polymer-based material through a forming process, such as rotational molding. In this example, the bucket 504 includes a first or top side 510, the bottom side 312 opposite the top side 510, the third or rear side 314 and the pair of lateral sides 316. In this example, the top side 510 also includes a plurality of grooves 512. Generally, the plurality of grooves 512 are spaced apart along the top side 510 between the lateral sides 316. In this example, the top side 510 includes three grooves 512; however the bucket 504 may include any number of grooves 512. The grooves 512 cooperate with the divider system 506 to separate the volume 300 into multiple compartments.

In this example, the divider system 506 includes a plurality of dividers or divider panels 514. The divider system 506 may be removably coupled to the bucket 204. The divider panels 514 have a shape that corresponds to the bucket 504, and in one example, each divider panel 514 is shaped similar to the lateral side 316. Each divider panel 514 is composed of a metal, metal alloy or polymer, and may be formed by casting, stamping, forging, molding, etc. In this example, the divider system 506 includes three divider panels 514; however, the divider system 506 may include any number of divider panels 514. Each of the divider panels 514 may be coupled to one of the grooves 512. Each of the grooves 512 retains the respective divider panel 514 within the bucket 504 to separate the volume 300 of the bucket 504 into multiple compartments.

In order to assemble the divider system 506, with the grooves 512 defined in the top side 510 of the bucket 504 and the divider panels 514 formed, each of the divider panels 514 is inserted into a respective one of the grooves 512 to couple the divider panel 514 to the bucket 504.

It should be noted that the HLBA 200 described with regard to FIGS. 1-14 may be configured differently to move and carry materials. In one example, with reference to FIGS. 22 and 23, a HLBA 550 is shown. As the HLBA 550 includes components that are substantially similar to or the same as the HLBA 200 discussed with regard to FIGS. 1-14, the same reference numerals will be used to denote the same or similar features. In this example, the HLBA 550 includes a reinforcing structure 552 and a bucket 554. The HLBA 550 is configured to be coupled to the loader arms 62, 64 of the loader 10 (FIG. 1) or the loader arms 1262, 1264 of the front loader 1202 associated with the compact utility tractor 1200 (FIG. 1A).

As the reinforcing structure 552 is substantially the same as the reinforcing structure 202 discussed with regard to FIGS. 1-14, the differences between the reinforcing structure 552 and the reinforcing structure 202 will be discussed herein, with the understanding that the remainder of the reinforcing structure 552 is the same as the reinforcing structure 202. In this example, the reinforcing structure 552 includes a frame 556, the second edge plate 208, the wear plate 210, the first wear strip 212 and the second wear strip 214. In one example, the frame 556 includes at least two support members 216, the first edge plate 218 and the pair of side mounting brackets 220. In this example, the frame 556 includes two support members 216*a*, 216*c*. Stated another way, in contrast to the reinforcing structure 202, which includes three support members 216*a*-216*c*, the reinforcing structure 552 includes two support members 216*a*, 216*c* for coupling the bucket 554 to the loader arms 62, 64 (FIG. 1) or the loader arms 1262, 1264 of the front loader 1202 associated with the compact utility tractor 1200 (FIG. 1A). This enables the bucket 554 to be formed integrally with a larger volume or carrying capacity.

As the bucket 554 is substantially the same as the bucket 204 discussed with regard to FIGS. 1-14, the differences between the bucket 554 and the bucket 204 will be discussed herein, with the understanding that the remainder of the bucket 554 is the same as the bucket 204. The bucket 554 is integrally formed and is a monolithic component. Generally, like the bucket 204, the bucket 554 is integrally formed of a polymer-based material through a forming process, such as rotational molding. In this example, the bucket 554 includes a single increased volume cavity 558. Stated another way, in contrast to the bucket 204, which includes two increased volume cavities 394, the bucket 554 includes a single increased volume cavity 558. The increased volume cavity 558 expands a carrying capacity of the bucket 554. In this example, the increased volume cavity 558 is defined between the support members 216*a*, 216*c*, and is formed to extend outward from the rear side 314. The increased volume cavity 558 is substantially concave; however, the increased volume cavity 558 may have any desired shape. In addition, due to the increased volume cavity 558, the bucket 554 may have a different number or configuration of vertical ribs 258 and horizontal ribs 388. The bucket 554 may also include a different number or configuration of kiss-off areas 390. As the reinforcing structure 552 is coupled to the bucket 554 in substantially the same manner as that described with regard to the HLBA 200, the assembly of the HLBA 550 will not be discussed in detail herein.

It should be noted that the HLBA 200 described with regard to FIGS. 1-14 may be configured differently to move and carry materials. In one example, with reference to FIGS. 24 and 25, a HLBA 600 is shown. As the HLBA 600 includes components that are substantially similar to or the same as the HLBA 200 discussed with regard to FIGS. 1-14, the same reference numerals will be used to denote the same or similar features. In this example, the HLBA 600 includes a reinforcing structure 602 and a bucket 604. The HLBA 600 is configured to be coupled to the loader arms 62, 64 of the loader 10 (FIG. 1) or the loader arms 1262, 1264 of the front loader 1202 associated with the compact utility tractor 1200 (FIG. 1A). It should be noted that while the reinforcing structure 602 is illustrated and described herein as being used with the bucket 604, the reinforcing structure 602 may also be used with the bucket 204 and the bucket 554, if desired.

In the illustrated example, the reinforcing structure 602 is external to the bucket 604. The reinforcing structure 602 facilitates removal and replacement of the bucket 604 should it be damaged. However, in other contexts, the reinforcing structure may be internal to the bucket, for example, with the bucket being constructed or formed (e.g., via an insert-molding operation) about the reinforcing structure in which molecular bonding or mechanical fasteners are used to connect, and transfer loads from, the bucket shell to the skeleton. As noted above, the bucket 604 may be, and is in the illustrated example, of light-duty construction such that the reinforcing structure 602 supports the bucket 604 and provides the primary load-handling component of the HLBA 600.

Figure 25:
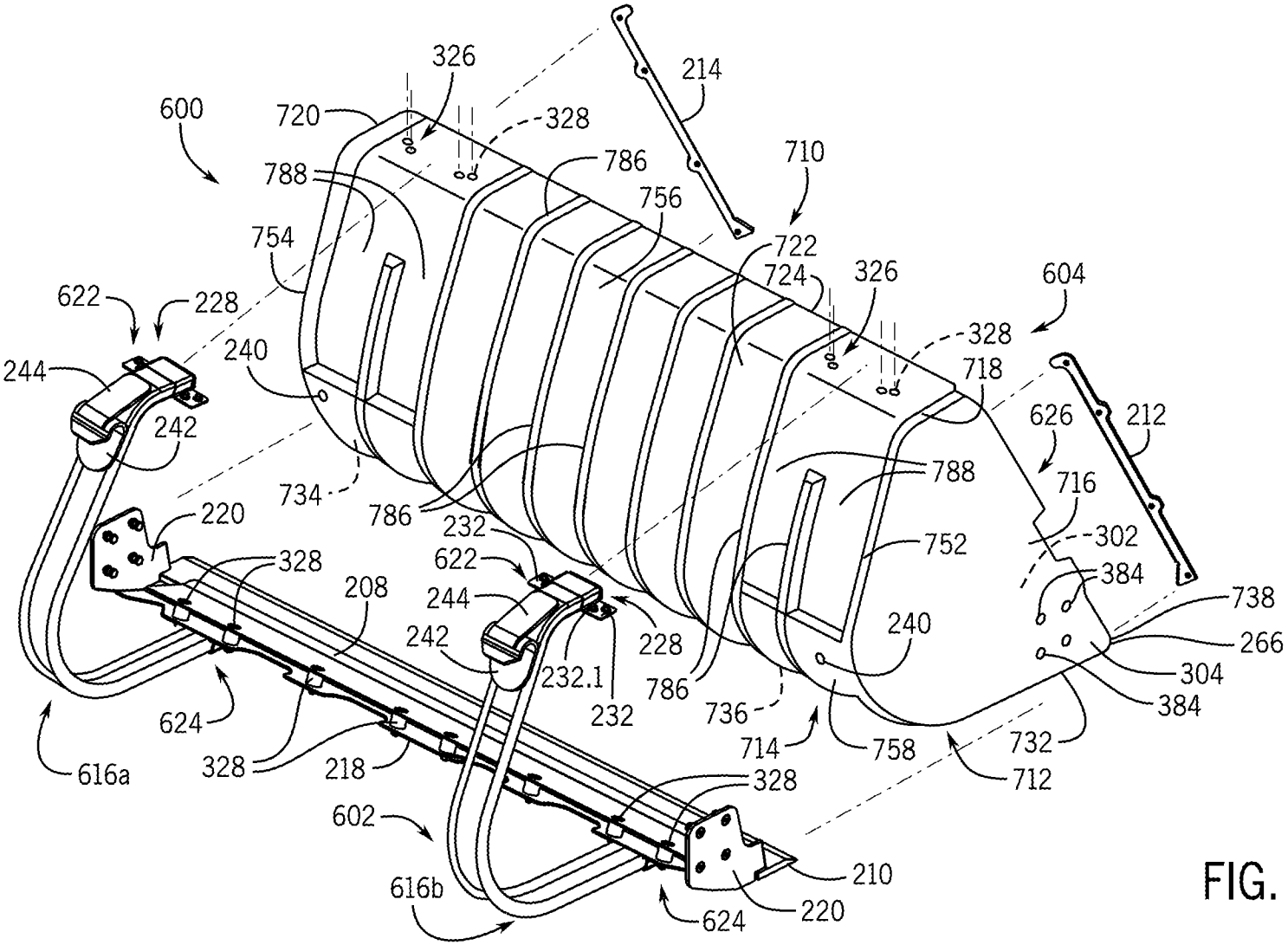
FIG. 25 is a rear perspective view of a hybrid load bucket assembly, which includes a reinforcing structure and the bucket of FIG. 24.

In one example, with reference to FIG. 25, the reinforcing structure 602 includes a frame 606, the second edge plate 208, the wear plate 210, the first wear strip 212 and the second wear strip 214. In one example, the frame 606 includes at least two support members 616, the first edge plate 218 and the pair of side mounting brackets 220. In this example, the frame 606 includes two support members 616*a*, 616*b*. Each of the support members 616*a*, 616*b* has a first end 622 and an opposite second end 624. The support members 616*a*, 616*b* are sized and shaped to cooperate with the size and shape of the bucket 604, and in one example, the support members 616*a*, 616*b* have a substantially C-shape. In one example, the support members 616*a*, 616*b* each include a pair of substantially hollow cylindrical tubes or rods; however, the cylindrical rods of the support members 616*a*, 616*b* may be solid, if desired. The support members 616*a*, 616*b* are composed of a metal or metal alloy, which is stamped, cast, forged, etc. The first end 622 of the support members 616*a*, 616*b* is coupled to the bucket 604, and the second end 624 of the support members 616*a*, 616*b* is coupled to the first edge plate 218 such that the support members 616*a*, 616*b* extend from the first edge plate 218 to a top side of the bucket 604. In one example, the second end 624 includes a taper, such that the second end 624 is flush with a portion of the first edge plate 218.

In one example, the first end 622 of each of the support members 616*a*, 616*b* is coupled to the bucket 604 by a respective one of the mounting brackets 228, and the second end 624 of each of the support members 616*a*, 616*b* is coupled to the first edge plate 218 by a respective one of the mounting brackets 228. In this example, the mounting brackets 228 are coupled to the respective first end 622 of the support members 616*a*, 616*b*, by welding. It should be noted, however, that the mounting brackets 228 may be integrally formed with the respective first end 622 or may be coupled to the first end 622 via other techniques, such as riveting, adhesives, etc. In certain instances, the mounting brackets 228 may also be coupled to the respective second end 624 of each of the support members 616*a*, 616*b*, via welding, however, any suitable technique may be employed, such as riveting, adhesives, integral forming, etc.

In one example, the coupling flanges 232 of the mounting brackets 228 associated with the first end 622 of the support members 616*a*, 616*b* include the single bore 232.1 that receives a respective mechanical fastener, such as the screw, to couple the mounting bracket 228 and the first end 622 of the support members 616*a*, 616*b* to the bucket 604. The coupling flanges 232 of the mounting brackets 228 associated with the second end 224 of the support members 616*a*, 616*b* each include a pair of the bores 232.1 that receives a respective mechanical fastener, such as the screw, to couple the mounting bracket 228 and the second end 624 of the support members 616*a*, 616*b* to the bucket 604. It should be noted, however, that the coupling flanges 232 may define any number of bores. Generally, each of the mechanical fasteners, such as the screws, may be secured with a nut or other device. In addition, the support members 216*a*, 216*c* include the hooks 242 for coupling the HLBA 600 to the loader 10. The reinforcement plate 244 may be coupled between the hooks 242 and the respective support member 216*a*, 216*c* proximate the first end 222, via welding, for example, to provide additional strength to the hooks 242.

The bucket 604 defines a volume 626 for receiving materials. The bucket 604 is integrally formed and is a monolithic component. In one example, the bucket 604 is formed of a polymer-based material, including, but not limited to, polyethylene, nylon and polyamide. In one example, the bucket 604 is formed through rotational molding; however, other techniques may be employed. The bucket 604 is formed with a double-wall structure, having the first, inner wall 302 and the opposite second, outer wall 304. In one embodiment, the double-wall structure of the bucket 604 is filled with the fill material 306 between the first, inner wall 302 and the second, outer wall 304. In other embodiments, the double-wall structure of the bucket 604 is hollow between the first, inner wall 302 and the second, outer wall 304 such that the double-wall structure is unfilled.

The bucket 604 includes a first or top side 710, a second or bottom side 712 opposite the top side 710, a third or rear side 714 and a pair of lateral sides 716. The top side 710 is formed integrally with the rear side 714 and the pair of lateral sides 716. The top side 710 has a first top side surface 718 opposite a second top side surface 720, a first top end surface 722 opposite a second top end surface 724. One of the lateral sides 716 is formed integrally with the first top side surface 718, and the other of the lateral sides 716 is formed integrally with the second top side surface 720. The first top end surface 722 is formed integrally with the rear side 714. The top side 710 includes a plurality of mounting features 326, which are spaced apart from the first top side surface 718 to the second top side surface 720. In one example, each of the mounting features 726 corresponds with one of the mounting brackets 228 for coupling the first end 622 of the respective support members 616*a*, 616*b* to the bucket 604. In this example, each of the mounting features 326 includes the bushings 328, which are each in communication with a respective pair of the bores 330 defined through the inner wall 302 and the outer wall 304 of the bucket 604. Generally, for each mechanical fastener received through the bore 232.1 associated with the mounting bracket 228, the top side 710 includes one respective bushing 328 and a respective pair of bores 330. Thus, in this example, each mounting feature 326 includes four bushings 328 and four pairs of bores 330, one for each of the four mechanical fasteners associated with one of the mounting brackets 228.

The bottom side 712 has a first bottom side surface 732 opposite a second bottom side surface 734, a first bottom end surface 736 opposite a second bottom end surface 738. One of the lateral sides 716 is formed integrally with the first bottom side surface 732, and the other of the lateral sides 716 is formed integrally with the second bottom side surface 734. The first bottom end surface 736 is formed integrally with the rear side 714. The bottom side 712 includes the support mounting features 339 and the pair of plate mounting features 340 (not shown). Each of the support mounting features 339 includes the plurality of bushings 328, which are each in communication with a respective pair of the plurality of bores 330 defined through the inner wall 302 and the outer wall 304 of the bucket 204. Generally, for each mechanical fastener received through the bore 232.1 associated with the mounting bracket 228, the bottom side 712 includes one respective bushing 328 and a respective pair of bores 330. Thus, in this example, each support mounting feature 339 includes two bushings 328 and two pairs of bores 330, one for each of the two mechanical fasteners associated with one of the mounting brackets 228 for receiving a mechanical fastener. The plate mounting features 340 each include a respective bushing 328, which is associated with a respective pair of bores 330 defined through the inner wall 302 and the outer wall 304 of the bucket 604. The bushing 328 receives a mechanical fastener to couple the second edge plate 208 to the bucket 604.

Figure 24:
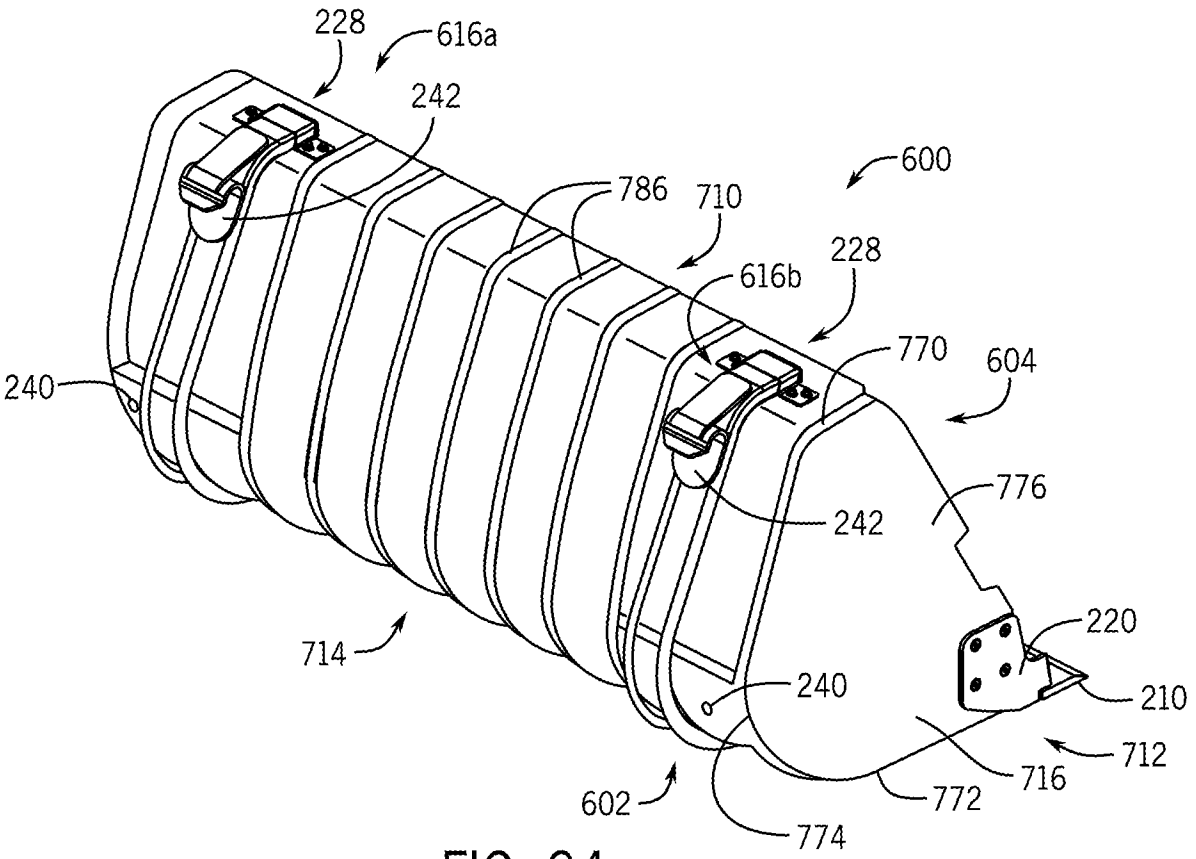
FIG. 24 is a rear perspective view of a bucket for use with another hybrid load bucket assembly.

With reference to FIG. 24, the rear side 714 has a first rear side surface 752 opposite a second rear side surface 754, a first rear end surface 756 opposite a second rear end surface 758. One of the lateral sides 716 is formed integrally with the first rear side surface 752, and the other of the lateral sides 716 is formed integrally with the second rear side surface 754. The first rear end surface 756 is formed integrally with the top side 710, and the second rear end surface 758 is formed integrally with the bottom side 712. The rear side 714 also includes the locating pins 240 for coupling the HLBA 600 to the coupler 74, 76, and thus, the loader arms 62, 64 (FIG. 1) or the loader arms 1262, 1264 of the front loader 1202 associated with the compact utility tractor 1200 (FIG. 1A).

The pair of lateral sides 716 is formed integrally with the top side 710, the bottom side 712 and the rear side 714 to define the volume 626. Each of the lateral sides 716 includes a first side surface 770 opposite a second side surface 772, and a first end surface 774 opposite a second end surface 776. The first side surface 770 is formed integrally with the top side 710, and the second side surface 712 is formed integrally with the bottom side 712. The first end surface 774 is formed integrally with the rear side 714. The second end surface 776 includes the plurality of mounting receptacles 378 (not shown). Each of the lateral sides 716 also includes the side bracket mounting features 384 proximate the second side surface 772 and the second end surface 776. Each of the side bracket mounting features 384 receive a respective mechanical fastener, such as a bolt, to couple the side mounting bracket 220 to the bucket 604.

The bucket 604 also includes a plurality of vertical ribs 786. The bucket 604 may also include the one or more kiss-off areas 390, the one or more decals 392 and the one or more increased volume cavities 394 (not shown). The vertical ribs 786 are spaced apart between the lateral sides 716 to impart additional rigidity to the bucket 604. Generally, the vertical ribs 786 extend from the top side 710 to the bottom side 712. The vertical ribs 786 may be interrupted to define channels 788 for each of the support members 616*a*, 616*b*. It should be noted that the number, location and the size of the vertical ribs 786 illustrated herein is merely exemplary, as the bucket 604 may include any number of vertical ribs 786 defined at any pre-determined location and having any pre-determined size that corresponds to a pre-determined stiffness for the bucket 604.

With reference to FIG. 25, in order to form the HLBA 600, in one example, the bucket 604 is integrally formed of a polymer-based material through a forming process, such as rotational molding. The bucket 604 is formed integrally with the bushings 328, the threaded inserts 362 and the associated bores 330, 380, 386. The bucket 604 is also formed integrally with the vertical ribs 786, which increase a strength of the bucket 604. The bucket 604 is formed integrally with the decals 392. The bucket 604 is formed integrally with the double-wall structure, which includes the inner wall 302 and the outer wall 304. In one example, the double-wall structure is filled with the fill material 306 during or after forming, to increase a stiffness of the bucket 604.

With the bucket 604 formed, the reinforcing structure 602 is coupled to the bucket 604. In one example, the second edge plate 208 is positioned along the outer wall 304 of the leading edge 266 of the bucket 604, and the first edge plate 218 is positioned along the inner wall 302 of the leading edge 266 such that the leading edge 266 is sandwiched between the first edge plate 218 and the second edge plate 208. The support members 616*a*, 616*b* are positioned about the bucket 604, with the hooks 242 coupled to the support members 616*a*, 616*b* and the mounting brackets 228 coupled to the first ends 622 and the second ends 624 of the support members 616*a*, 616*b*. Mechanical fasteners are inserted through the coupling flanges 232 of the mounting brackets 228 and through the bushings 328 formed integrally with the bucket 604 to couple the support members 616*a*, 616*b*, the first edge plate 218 and the second edge plate 208 to the bucket 604.

The wear plate 210 is inserted between the first edge plate 218 and the second edge plate 208. The side mounting brackets 220 are coupled to the side bracket mounting features 384. Mechanical fasteners are positioned through the bores 264 of the side mounting brackets 220 to matingly engage with the threaded inserts 362 of the side bracket mounting features 384 to couple the side mounting brackets 220 to the bucket 604. The wear plate 210 is coupled to the first edge plate 218 and the second edge plate 208, via welding, for example, and the side mounting brackets 220 are coupled to the wear plate 210, via welding, for example. It should be noted that the wear plate 210 may be welded to the first edge plate 218, the second edge plate 208 and the side mounting brackets 220 to form a sub-assembly, which is coupled to the bucket 604. With the reinforcing structure 602 coupled to the bucket 604, pins may be positioned through the cross-bore of the locating pins 240 to couple the HLBA 600 to the respective coupler 74, 76, and thus, the respective loader arm 62, 64 (FIG. 1) or the loader arms 1262, 1264 of the front loader 1202 associated with the compact utility tractor 1200 (FIG. 1A).

As the reinforcing structure 602 is coupled to the bucket 604 via mechanical fasteners, which are removable, if the bucket 604 becomes damaged or worn, the bucket 604 may be easily replaced by removing it from the reinforcing structure 602 and coupling the reinforcing structure 602 to another bucket 604. Moreover, the removable nature of the reinforcing structure 602 improves a packaging and shipping of the bucket 604. For example, the buckets 604 are able to be shipped with the reinforcing structure 602 removed, which enables the buckets 604 to be stacked or nested together. By stacking or nesting the buckets 604 together, a larger quantity of buckets 604 may be transported by a transportation vehicle. This reduces shipping costs associated with the buckets 604. The reinforcing structure 602 may then be coupled to the buckets 604 upon delivery of the buckets 604 to the purchaser.

Figure 26:
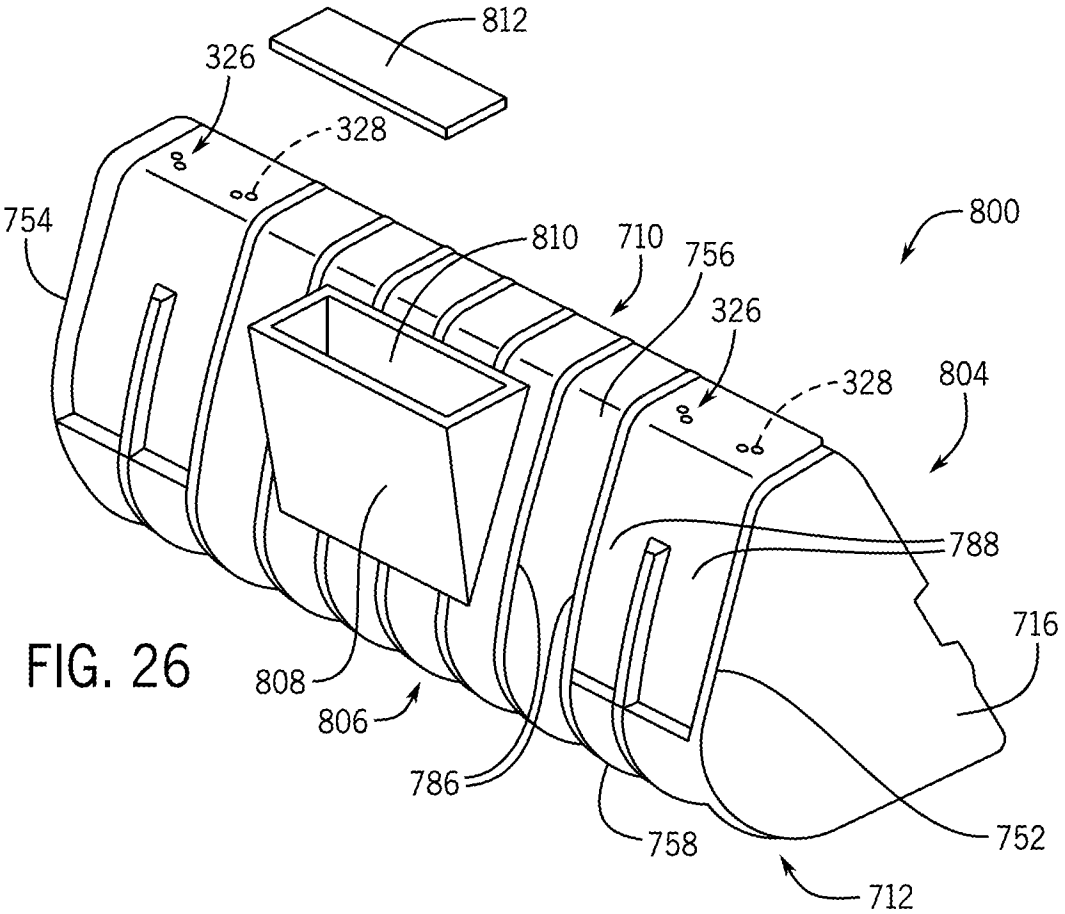
FIG. 26 is a rear perspective view of a bucket for use with another hybrid load bucket assembly in which the bucket includes a tool box.

It should be noted that the HLBA 600 described with regard to FIGS. 24 and 25 may be configured differently to move and carry materials. In one example, with reference to FIG. 26, a HLBA 800 is shown. As the HLBA 800 includes components that are substantially similar to or the same as the HLBA 600 discussed with regard to FIGS. 24 and 25, the same reference numerals will be used to denote the same or similar features. In this example, the HLBA 800 includes the reinforcing structure 602 and a bucket 804. For clarity, the reinforcing structure 602 is not shown attached to the bucket 804 in FIG. 26. The HLBA 800 is configured to be coupled to the loader arms 62, 64 of the loader 10 (FIG. 1) or the loader arms 1262, 1264 of the front loader 1202 associated with the compact utility tractor 1200 (FIG. 1A).

As the bucket 804 is substantially the same as the bucket 604 discussed with regard to FIGS. 24 and 25, the differences between the bucket 804 and the bucket 604 will be discussed herein, with the understanding that the remainder of the bucket 804 is the same as the bucket 604. The bucket 804 is integrally formed and is a monolithic component. Generally, like the bucket 604, the bucket 804 is integrally formed of a polymer-based material through a forming process, such as rotational molding. In this example, the bucket 804 includes the first or top side 710, the bottom side 712 opposite the top side 710, a third or rear side 806 and the pair of lateral sides 716. In this example, the rear side 806 also includes an integrally formed tool box 808. The tool box 808 extends outwardly from the rear side 806, and is defined on the rear side 806 so as to be between the support members 616*a*, 616*b* (not shown). The tool box 808 defines a receptacle 810 for an operator of the loader 10 (FIG. 1) or the compact utility tractor 1200 (FIG. 1A) to store objects, such as tools or personal items on the bucket 804. The tool box 808 may also include a cover 812. The cover 812 may be formed integrally with the bucket 804 and coupled to the bucket 804 via a living hinge, for example, or the cover 812 may be formed separately and coupled to the tool box 808 via a press-fit, for example. The cover 812 may be composed of the same material as the bucket 804. As the bucket 804 may be formed in the same manner as the bucket 604, the forming of the bucket 604 will not be discussed herein.

It should be noted that the HLBA 200 described with regard to FIGS. 1-14 may be configured differently to move and carry materials. In one example, with reference to FIGS. 27 and 28, a HLBA 900 is shown. As the HLBA 900 includes components that are substantially similar to or the same as the HLBA 200 discussed with regard to FIGS. 1-14, the same reference numerals will be used to denote the same or similar features. In this example, the HLBA 900 includes a reinforcing structure 902 and a bucket 904. The HLBA 900 is configured to be coupled to the loader arms 62, 64 of the loader 10 (FIG. 10) or the loader arms 1262, 1264 of the front loader 1202 associated with the compact utility tractor 1200 (FIG. 1A).

Figure 27:
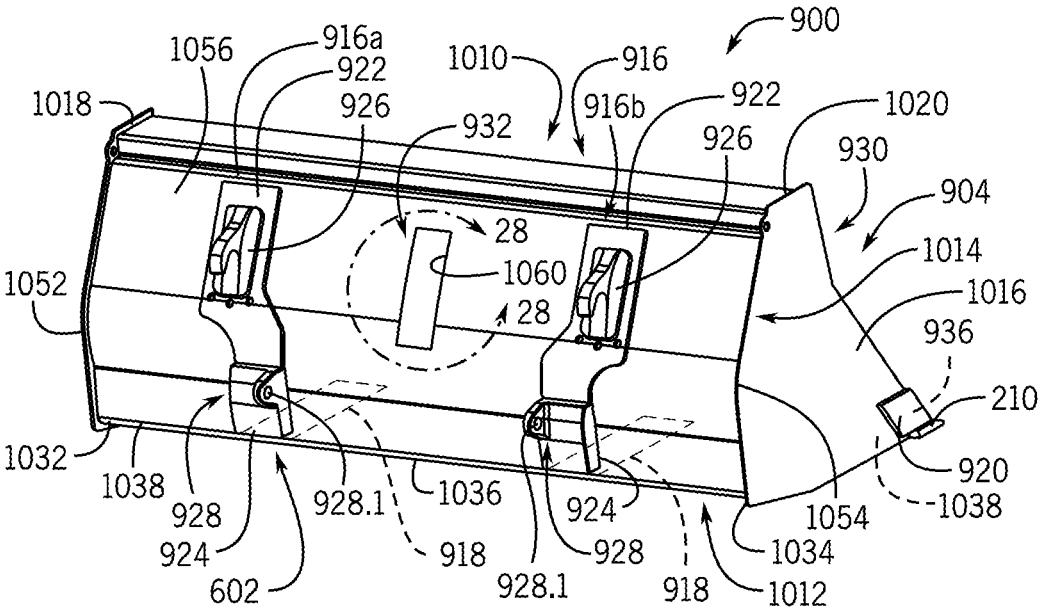
FIG. 27 is a rear perspective view of another hybrid load bucket assembly, which includes a reinforcing structure, a bucket and an indicator system that enables an operator of the loader to view an amount of material contained within the volume of the bucket.

In one example, with reference to FIG. 27, the reinforcing structure 902 includes a frame 906 and the wear plate 210. In one example, the frame 906 includes at least two support members 916, a pair of bottom supports 918 and a pair of side reinforcements 920. In this example, the frame 906 includes two support members 916*a*, 916*b*. Each of the support members 916*a*, 916*b* has a first end 922 and an opposite second end 924. The support members 916*a*, 916*b* extend along a rear side 1014 of the bucket 904, with the first end 922 coupled near a top side 1010 of the bucket 904 and the second end 924 coupled near a bottom side 1012 of the bucket 904. In one example, the support members 916*a*, 916*b* are plates. The support members 916*a*, 916*b* are composed of a metal or metal alloy, which is stamped, cast, forged, etc. In one example, the support members 916*a*, 916*b* are coupled to the rear side 1014 of the bucket 904 via welding, however, other techniques may be employed.

In one example, the first end 622 of each of the support members 616*a*, 616*b* includes upper mount hooks or hooks 926 for coupling the HLBA 900 to the loader 10. In this example, the hooks 926 are coupled to the support members 916*a*, 916*b* by welding, however, one or more mechanical fasteners may be used. Moreover, the hooks 926 may be formed integrally with the support members 916*a*, 916*b*, if desired. Generally, the hooks 926 are composed of a metal or metal alloy, and are stamped, cast, forged, etc. The hooks 926 define a substantially U-shaped opening for coupling the HLBA 900 to the cross-rod 78 of the carrier 68 (FIG. 1). The second end 924 of each of the support members 916*a*, 916*b* includes a respective coupling bracket 928. The coupling bracket 928 defines a bore 928.1 for receiving a pin to couple the bucket 904 to the respective coupler 74, 76, and thus, the respective one of the loader arms 62, 64.

The pair of bottom supports 918 are coupled to the bottom side panel 1012 of the bucket 904, and are elongated plates. The bottom supports 918 are each composed of a metal or metal alloy, which is stamped, cast, forged, etc. In one example, the bottom supports 918 are coupled to the bottom side panel 1012 of the bucket 904 via welding, however, other techniques may be employed. Each of the pair of side reinforcements 920 is coupled to a respective one of a pair of lateral side panels 1016 of the bucket 904 to provide additional strength for the bucket 904 near a leading edge 936 of the bucket 904. The side reinforcements 920 are each composed of a metal or metal alloy, which is stamped, cast, forged, etc. In one example, the side reinforcements 920 are coupled to the respective lateral side panels 1016 of the bucket 904 via welding, however, other techniques may be employed.

The bucket 904 defines a volume 930 for receiving materials. In one example, the bucket 904 includes a first or top side panel 1010, a second or bottom side panel 1012 opposite the top side panel 1010, a third or rear side panel 1014, a pair of lateral side panels 1016 and an indicator system 932. The top side panel 1010 is coupled to the rear side panel 1014 and the pair of lateral side panels 1016. The top side panel 1010 has a first top side 1018 opposite a second top side 1020. One of the lateral side panels 1016 is coupled to the first top side 1018, and the other of the lateral side panels 1016 is coupled to the second top side 1020. An end 1022 of the top side panel 1010 is coupled to the rear side panel 1014.

The bottom side panel 1012 has a first bottom side 1032 opposite a second bottom side 1034. One of the lateral side panels 1016 is coupled to the first bottom side 1032, and the other of the lateral side panels 1016 is coupled to the second bottom side 1034. An end 1036 of the bottom side panel 1012 is coupled to the rear side panel 1014, and another end 1038 is coupled to the wear plate 210. The bottom supports 918 are coupled to the bottom side panel 1012 proximate the end 1036 and extend toward a leading edge 936 of the bucket 904. The rear side panel 1014 has a first rear side 1052 opposite a second rear side 1054. One of the lateral side panels 1016 is coupled to the first rear side 1052, and the other of the lateral side panels 1016 is coupled to the second rear side 1054. An end 1056 of the rear side panel 1014 is coupled to the top side panel 1010, and a second end 1058 of the rear side panel 1014 is coupled to the bottom side panel 1012.

The support members 916*a*, 916*b* are coupled to the rear side panel 1014 between the first rear side 1052 and the second rear side 1054. The rear side panel 1014 also defines an opening 1060. The opening 1060 is defined through the rear side panel 1014 so as to be positioned between the support members 916*a*, 916*b*. By defining the opening 1060 between the support members 916*a*, 916*b*, the opening 1060 is unobstructed by the loader arms 62, 64 and is visible to an operator in the cab 28 of the loader 10 (FIG. 1) or the operator of the compact utility tractor 1200 (FIG. 1A). In one example, the opening 1060 is rectangular in shape, however, the opening 1060 may have any desired shape.

Each of the pair of lateral side panels 1016 is coupled to the top side panel 1010, the bottom side panel 1012 and the rear side panel 1014 to define the volume 930. In this regard, in one example, each of the top side panel 1010, the bottom side panel 1012, the rear side panel 1014 and the lateral side panels 1016 are composed of a metal or metal alloy, and are stamped, cast, forged, etc. In one example, the top side panel 1010, the bottom side panel 1012, the rear side panel 1014 and the lateral side panels 1016 are coupled together via welding. The side reinforcements 920 are coupled to one of the lateral side panels 1016. The lateral side panels 1016 are also coupled to the wear plate 210.

Figure 28:
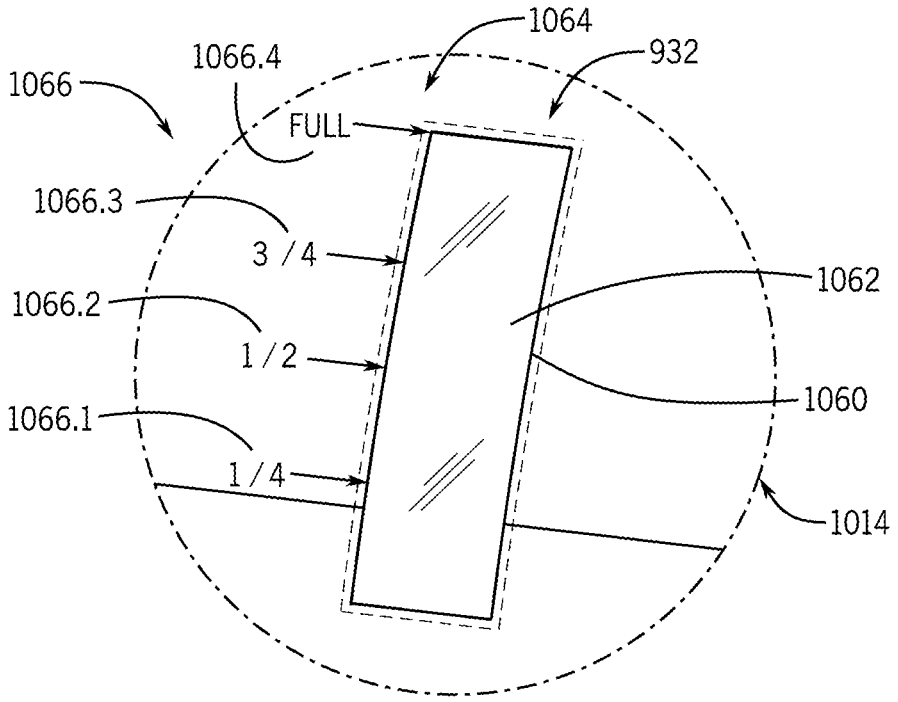
FIG. 28 is a detail view taken at 28-28 of FIG. 27, which illustrates the indicator system.

With reference to FIG. 28, the indicator system 932 is coupled to the opening 1060 defined in and through the rear side panel 1014. In one example, the indicator system 932 includes a translucent panel 1062 and a level indicator or gauge 1064. The indicator system 932 defines a translucent region coupled to the rear side panel 1014 that is configured to transmit light from the volume 930 of the bucket 904 to the cab 28 of the loader 10 such that the operator may view the volume of material within the bucket 904 while retaining the material within the volume 930 of the bucket 904. It should be noted that while the indicator system 932 and the opening 1060 are described and illustrated herein as being defined on the rear side panel 1014, the indicator system 932 and the opening 1060 may be defined through any portion of the bucket 904 that is visible to the operator from the cab 28 of the loader 10 (FIG. 1) or the operator of the compact utility tractor 1200 (FIG. 1A).

The translucent panel 1062 is composed of a translucent polymer-based material, including, but not limited to, acrylic glass. In certain instances, the translucent panel 1062 may be transparent. The translucent panel 1062 may be formed though molding, extrusion, etc. The translucent panel 1062 is sized and shaped to cover the opening 1060 defined in the rear side panel 1014 to retain the material within the volume 930 of the bucket 904. The translucent panel 1062 may be coupled to the rear side panel 1014 through any technique, and in one example, the translucent panel 1062 is secured about a perimeter of the opening 1060 with an adhesive. In another example, the translucent panel 1062 is received within a slot defined about a portion of the perimeter of the opening 1060. In yet another example, the translucent panel 1062 may define one or more bores, and may be coupled to the rear side panel 1014 via one or more mechanical fasteners that are received through corresponding one or more bores defined in the rear side panel 1014. In yet another example, the rear side panel 1014 may have a double-wall structure, and the translucent panel 1062 may be positioned within the double-wall structure and secured with adhesives, welding, etc. In other instances, the translucent panel 1062 may be integrally formed with the bucket 904 and comprise part of the structure of the bucket 904. In other instances, the translucent panel 1062 may comprise an entirety of the bucket 904, such that the bucket 904 itself is translucent. In yet other instances, the translucent panel 1062 may comprise an entirety of the rear side panel 1014 such that the rear side of the bucket 904 is comprised of the translucent panel 1062. It should be understood that other sides, such as the top side panel 1010, etc. of the bucket 904 may be composed of the translucent panel 1062, if desired.

The gauge 1064 is coupled to the bucket 904 proximate the translucent panel 1062. The gauge 1064 provides a textual or graphical level indicator of a level of the material within the volume 930 of the bucket 904. In one example, the gauge 1064 includes a plurality of markings 1066 that indicate an amount of materials within the volume 930 of the bucket 904. In this example, the markings 1066 include a marking 1066.1 that indicates the volume 903 is about ¼ filled, a marking 1066.2 that indicates the volume 903 is about ½ filled, a marking 1066.3 that indicates the volume 903 is about ¾ filled and a marking 1066.4 that indicates the volume 903 is about full. It should be noted that the number of the markings 1066 and the quantity indicated by the markings 1066 are merely exemplary. The gauge 1064 may comprise a printed sticker, which is adhered to the rear side panel 1014 proximate the translucent panel 1062. Alternatively, the gauge 1064 may be defined on the rear side panel 1014 proximate the translucent panel 1062 via stamping, etching, etc.

With reference to FIG. 27, in order to form the HLBA 900, in one example, with the top side panel 1010, the bottom side panel 1012, the rear side panel 1014 and the lateral side panels 1016 formed, the top side panel 1010, the bottom side panel 1012, the rear side panel 1014 and the lateral side panels 1016 are coupled together, via welding, for example. The support members 916*a*, 916*b*, with the hooks 926 and the coupling brackets 928 attached, are coupled to the rear side panel 1014 so as to be on either side of the opening 1060 defined in the rear side panel 1014. The bottom supports 918 are coupled to the bottom side panel 1012, via welding, for example. The side reinforcements 920 are each coupled to the respective one of the lateral side panels 1016, and the wear plate 210 is coupled to the bottom side panel 1012 and the lateral side panels 1016. The translucent panel 1062 is coupled about the opening 1060 with the adhesive. In the example of the gauge 1064 printed on a sticker, the gauge 1064 is coupled proximate the opening 1060. With the indicator system 932 coupled to the bucket 904, the operator can view the amount of materials contained within the volume 930 of the bucket 904 from within the cab 28 (FIG. 1) or the operator can view the volume 930 within the bucket 904 without leaving the compact utility tractor 1200 (FIG. 1A). Thus, the indicator system 932 enables the operator to determine the quantity of materials within the bucket 904 without leaving the cab 28 of the loader 10 (FIG. 1) or leaving an operator station of the compact utility tractor 1200 (FIG. 1A).

Figure 29:
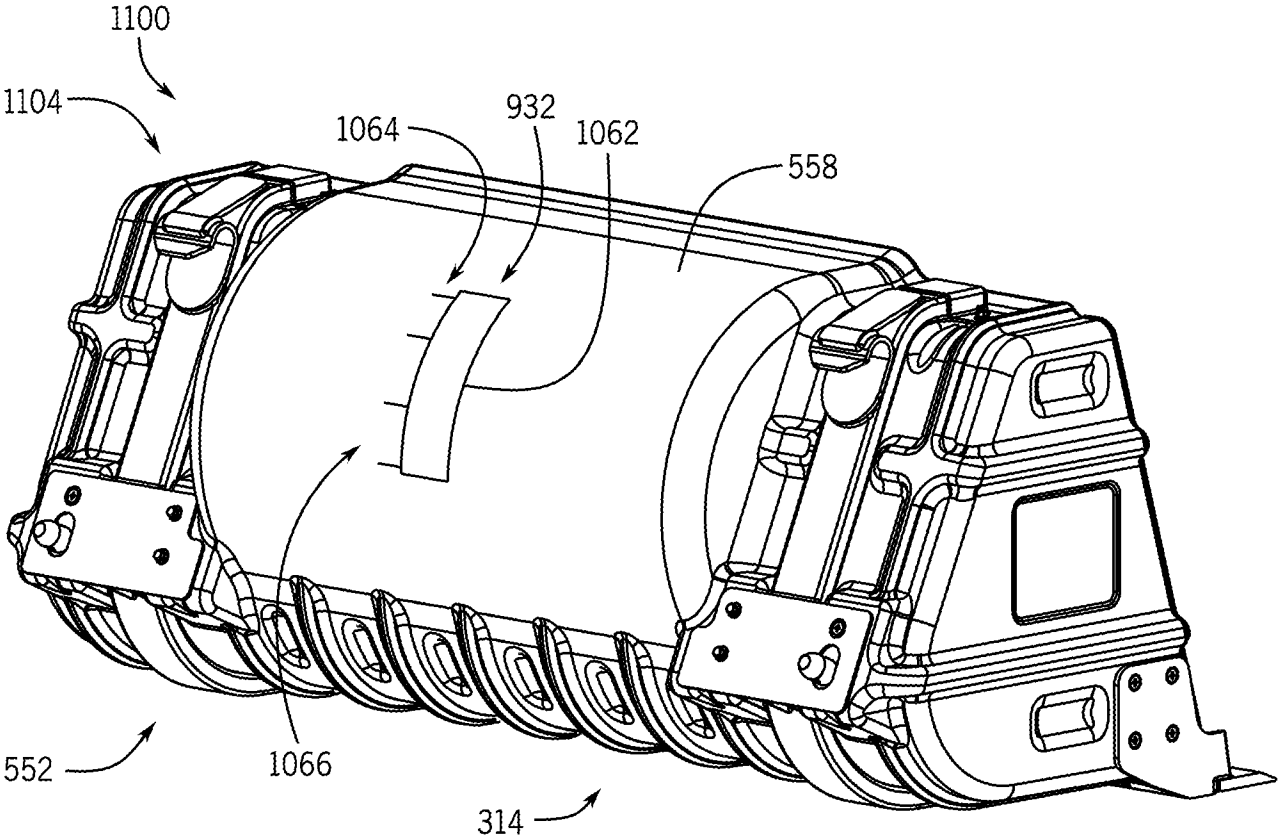
FIG. 29 is a rear perspective view of another hybrid load bucket assembly, which includes a reinforcing structure, a bucket and an indicator system that enables an operator of the loader to view an amount of material contained within the volume of the bucket.

It should be noted that the HLBA 900 described with regard to FIGS. 27 and 28 may be configured differently to move and carry materials. In one example, with reference to FIG. 29, a HLBA 1100 is shown. As the HLBA 1100 includes components that are substantially similar to or the same as the HLBA 550 discussed with regard to FIGS. 22 and 23 and the HLBA 900 discussed with regard to FIGS. 27 and 28, the same reference numerals will be used to denote the same or similar features. In this example, the HLBA 1100 includes the reinforcing structure 552 and a bucket 1104. The HLBA 1100 is configured to be coupled to the loader arms 62, 64 of the loader 10 (FIG. 1) or the loader arms 1262, 1264 of the front loader 1202 associated with the compact utility tractor 1200 (FIG. 1A).

Figure 22:
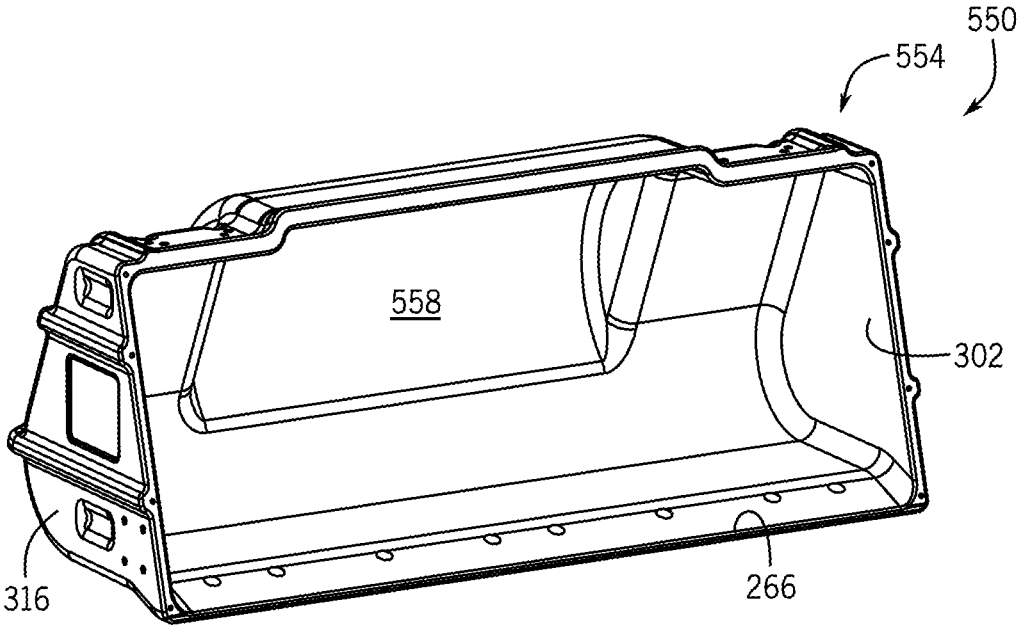
FIG. 22 is a front perspective view of a bucket for use with another hybrid load bucket assembly.
Figure 23:
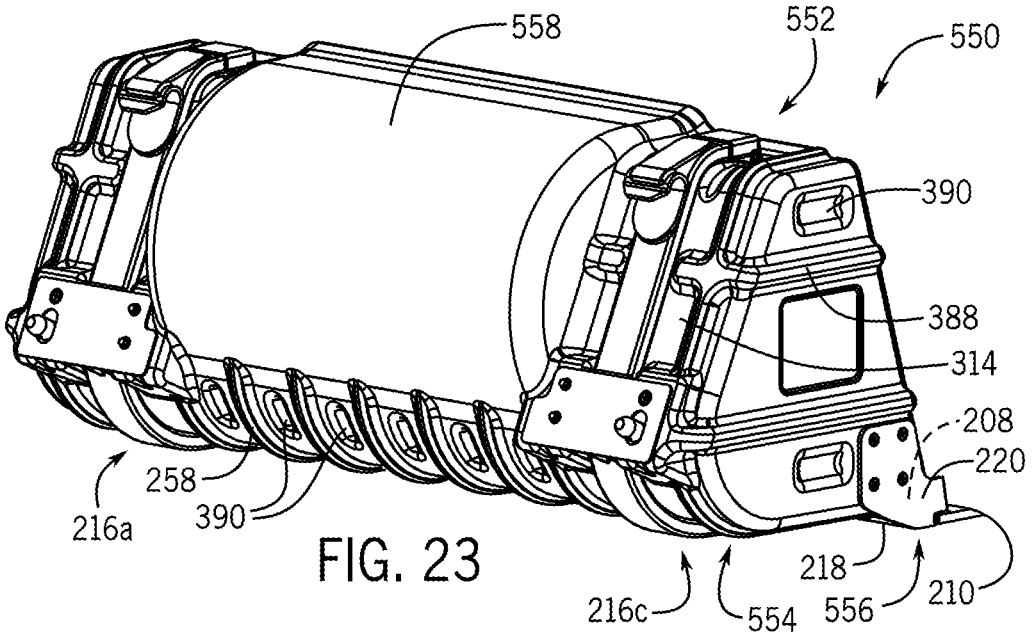
FIG. 23 is a rear perspective view of a hybrid load bucket assembly, which includes a reinforcing structure and the bucket of FIG. 22.

As the bucket 1104 is substantially the same as the bucket 554 discussed with regard to FIGS. 22 and 23, the differences between the bucket 1104 and the bucket 554 will be discussed herein, with the understanding that the remainder of the bucket 1104 is the same as the bucket 554. The bucket 1104 is integrally formed and is a monolithic component. Generally, like the bucket 554, the bucket 1104 is integrally formed of a polymer-based material through a forming process, such as rotational molding. In this example, the bucket 1104 includes the indicator system 932 defined on the single increased volume cavity 558. In this example, the indicator system 932 includes the translucent panel 1062 and the gauge 1064 defined on a surface of the increased volume cavity 558 so as to be viewable by an operator in the cab 28 of the loader 10 (FIG. 1) or by the operator of the compact utility tractor 1200 (FIG. 1A). In this example, the translucent panel 1062 may be formed integrally with the bucket 1104 and the gauge 1064 may be integrally defined on the bucket 1104 proximate the translucent panel 1062. Thus, the indicator system 932 may be employed with a double-wall bucket that is composed of a polymer-based material. Further, it should be noted that the indicator system 932, including the translucent panel 1062 and the gauge 1064, may be formed integrally with the bucket 204 and the bucket 604, if desired.

Moreover, it should be understood that the translucent panel associated with a bucket need not be limited to the translucent panel 1062. In this regard, generally, at least a portion of the respective bucket may include a translucent or transparent area. For example, one or more of a top side, a bottom side, lateral sides and/or a rear side of the bucket may be translucent or transparent. Moreover, an entirety of the bucket may be formed of a translucent or transparent material, such as a translucent or transparent polymer-based material. As a further example, the bucket may include a plurality of translucent or transparent panels, such as the translucent panel 1062, which may be arranged in any desired orientation on the bucket to enable the operator to view a volume of material within the bucket.

Also, the following examples are provided, which are numbered for easier reference:

1. A hybrid bucket assembly for a work vehicle having movable loader arms. The bucket assembly includes a reinforcing structure having a first edge plate, a second edge plate and at least two support members extending from the first edge plate. The reinforcing structure is for coupling to the movable loader arms. The bucket assembly includes a double-wall bucket defining a volume for carrying material. The bucket is coupled to the at least two support members of the reinforcing structure. The bucket has a leading edge coupled between the first edge plate and the second edge plate.

2. The bucket assembly of example 1, wherein a wear plate coupled between the first edge plate and the second edge plate so as to be proximate the leading edge of the bucket, and a plurality of bushings integrally formed with the double-wall bucket for receiving a mechanical fastener to couple the first edge plate to the second edge plate.

3. The bucket assembly of example 1, wherein the double-wall bucket is formed from a polymer-based material, and the double-wall of the bucket is filled with a fill material.

4. The bucket assembly of example 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members comprise hollow tubes that extend from the first edge plate to the top side.

5. The bucket assembly of example 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members each comprise a pair of rods that extends from the first edge plate to the top side.

6. The bucket assembly of example 1, wherein the at least two support members each include a mounting structure for coupling to a respective one of the movable loader arms.

7. The bucket assembly of example 6, wherein the bucket includes at least two locator pins molded into the bucket for coupling the bucket assembly to the movable loader arms.

8. The bucket assembly of example 1, wherein the reinforcing structure is removable for stacking the bucket within a second bucket formed from a polymer-based material.

9. The bucket assembly of example 1, wherein the bucket defines at least one enlarged cavity proximate at least one of the at least two support members.

10. The bucket assembly of example 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side, and the bucket further comprises a tool box defined on the bucket proximate the top side.

11. The bucket assembly of example 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side, and the bucket further comprises a plurality of removable dividers that extend within the volume of the bucket from the top side to the bottom side and are spaced apart between the lateral sides.

12. The bucket assembly of example 1, wherein the bucket has a top side formed integrally with an opposite bottom side, lateral sides formed integrally with opposite lateral surfaces of the bottom side and the top side, and a rear side formed integrally with the top side, the bottom side and the lateral sides, and the bucket further comprises a respective wear strip coupled to each of the lateral sides to extend along the respective lateral sides.

13. A hybrid bucket assembly for a work vehicle having movable loader arms and an operator cab. The bucket assembly includes a top side, a bottom side, and lateral sides formed integrally with or coupled to opposite lateral surfaces of the bottom side and the top side. The bucket includes a rear side formed integrally with or coupled to the top side, the bottom side and the lateral sides. The top side, the bottom side, the rear side and the lateral sides form a bucket having a volume for carrying material. The rear side includes a translucent region that is configured to transmit light from the volume to the operator cab and to retain material within the volume.

14. The bucket assembly of example 13, wherein the translucent region is a translucent panel coupled to the rear side that transmits the light from the volume to the operator cab.

15. The bucket assembly of example 14, wherein an indicator is defined on the rear side adjacent to the translucent panel that indicates an amount of the material within the volume.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A hybrid bucket assembly for a work vehicle having movable loader arms, the bucket assembly comprising:

a reinforcing structure having a first edge plate, a second edge plate and at least two support members extending from the first edge plate, the reinforcing structure for coupling to the movable loader arms;

a double-wall bucket defining a volume for carrying material, the bucket coupled to the at least two support members of the reinforcing structure, the bucket having a leading edge coupled between the first edge plate and the second edge plate; and a wear plate coupled between the first edge plate and the second edge plate so as to be proximate the leading edge of the bucket, and a plurality of bushings integrally formed with the double-wall bucket for receiving a mechanical fastener to couple the first edge plate to the second edge plate.

2. The bucket assembly of claim 1, wherein the double-wall bucket is formed from a polymer-based material, and the double-wall of the bucket is filled with a fill material.

3. The bucket assembly of claim 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members comprise hollow tubes that extend from the first edge plate to the top side.

4. The bucket assembly of claim 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members each comprise a pair of rods that extends from the first edge plate to the top side.

5. The bucket assembly of claim 1, wherein the at least two support members each include a mounting structure for coupling to a respective one of the movable loader arms.

6. The bucket assembly of claim 5, wherein the bucket includes at least two locator pins molded into the bucket for coupling the bucket assembly to the movable loader arms.

7. The bucket assembly of claim 1, wherein the reinforcing structure is removable for stacking the bucket within a second bucket formed from a polymer-based material.

8. The bucket assembly of claim 1, wherein the bucket defines at least one enlarged cavity proximate at least one of the at least two support members.

9. The bucket assembly of claim 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side, and the bucket further comprises a tool box defined on the bucket proximate the top side.

10. The bucket assembly of claim 1, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side, and the bucket further comprises a plurality of removable dividers that extend within the volume of the bucket from the top side to the bottom side and are spaced apart between the lateral sides.

11. The bucket assembly of claim 1, wherein the bucket has a top side formed integrally with an opposite bottom side, lateral sides formed integrally with opposite lateral surfaces of the bottom side and the top side, and a rear side formed integrally with the top side, the bottom side and the lateral sides, and the bucket further comprises a respective wear strip coupled to each of the lateral sides to extend along the respective lateral sides.

12. The A hybrid bucket assembly for a work vehicle having movable loader arms, the bucket assembly comprising:

a reinforcing structure having a first edge plate, a second edge plate, a wear plate and at least two support members extending from the first edge plate, the wear plate coupled between the first edge plate and the second edge plate, the reinforcing structure for coupling to the movable loader arms; and a double-wall bucket formed from a polymer-based material defining a volume for carrying material, the bucket coupled to the at least two support members of the reinforcing structure, the bucket having a leading edge coupled between the first edge plate and the second edge plate so as to be proximate the wear plate.

13. The bucket assembly of claim 12, wherein the double-wall of the bucket is filled with a fill material, and a plurality of bushings are integrally formed with the double-wall bucket for receiving a mechanical fastener to couple the first edge plate to the second edge plate.

14. The bucket assembly of claim 12, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members comprise hollow tubes that extend from the first edge plate to the top side.

15. The bucket assembly of claim 12, wherein the bucket has a top side formed integrally with an opposite bottom side, lateral sides formed integrally with opposite lateral surfaces of the bottom side and the top side, and a rear side formed integrally with the top side, the bottom side and the lateral sides, with the leading edge defined on the bottom side and the at least two support members each comprise a pair of rods that extends from the first edge plate to the top side.

16. A hybrid bucket assembly for a work vehicle having movable loader arms, the bucket assembly comprising:

a reinforcing structure having a first edge plate, a second edge plate, a wear plate, and at least two support members extending from the first edge plate, the wear plate coupled between the first edge plate and the second edge plate, the reinforcing structure for coupling to the movable loader arms; and a double-wall bucket defining a volume for carrying material, the bucket coupled to the at least two support members of the reinforcing structure, the bucket having a leading edge coupled between the first edge plate and the second edge plate.

17. The bucket assembly of claim 16, the bucket comprising:

a top side;

a bottom side;

lateral sides formed integrally with or coupled to opposite lateral surfaces of the bottom side and the top side; and a rear side formed integrally with or coupled to the top side, the bottom side and the lateral sides, wherein the top side, the bottom side, the rear side and the lateral sides form a bucket having a volume for carrying material, and wherein the rear side comprises a translucent region that allows light from the volume to be operably viewable in an operator position, and to retain material within the volume.

18. The bucket assembly of claim 17, wherein the translucent region is a translucent panel coupled to the rear side that allows the light to be operably viewed from the volume at the operator position.

19. The bucket assembly of claim 17, wherein an indicator is disposed on the rear side adjacent to the translucent region that is operably indicative of an amount of the material within the volume.

* * * * *